US006981761B2

(12) United States Patent
Usui et al.

(10) Patent No.: US 6,981,761 B2
(45) Date of Patent: Jan. 3, 2006

(54) DROPLET DISCHARGE DEVICE AND LIQUID FILLING METHOD THEREFOR, AND DEVICE MANUFACTURING APPARATUS, DEVICE MANUFACTURING METHOD AND DEVICE

(75) Inventors: Takahiro Usui, Shiojiri (JP); Hirofumi Teramae, Matsumoto (JP); Satoru Hosono, Toyoshina-machi (JP)

(73) Assignee: Seiko Epson Corporation, Tokyo (JP)

( * ) Notice: Subject to any disclaimer, the term of this patent is extended or adjusted under 35 U.S.C. 154(b) by 93 days.

(21) Appl. No.: 10/237,100

(22) Filed: Sep. 9, 2002

(65) Prior Publication Data

US 2004/0070651 A1 Apr. 15, 2004

(30) Foreign Application Priority Data

| | | |
|---|---|---|
| Sep. 11, 2001 | (JP) | 2001-274804 |
| Sep. 11, 2001 | (JP) | 2001-274819 |
| Mar. 18, 2002 | (JP) | 2002-074299 |
| Sep. 6, 2002 | (JP) | 2002-261163 |

(51) Int. Cl.
*B41J 2/175* (2006.01)

(52) U.S. Cl. ..... 347/85

(58) Field of Classification Search ..... 347/21, 347/43, 85

See application file for complete search history.

(56) References Cited

U.S. PATENT DOCUMENTS

| | | | | |
|---|---|---|---|---|
| 4,614,953 | A * | 9/1986 | Lapeyre | 347/43 |
| 5,907,377 | A | 5/1999 | Nishida et al. | |
| 6,443,551 | B1 * | 9/2002 | Matsumoto | 347/21 |
| 6,679,585 | B2 * | 1/2004 | Kato et al. | 347/43 |

FOREIGN PATENT DOCUMENTS

| | | |
|---|---|---|
| EP | 0 702 250 A2 | 3/1996 |
| JP | A 62-66941 | 3/1987 |
| JP | A 1-148557 | 6/1989 |
| JP | A 8-146214 | 6/1996 |
| JP | A 8-271724 | 10/1996 |
| JP | A 10-133194 | 5/1998 |
| JP | A 10-148709 | 6/1998 |
| JP | A 10-160925 | 6/1998 |
| JP | A 10-170712 | 6/1998 |
| JP | A 10-268126 | 10/1998 |
| JP | A 10-282329 | 10/1998 |
| JP | A 10-286977 | 10/1998 |
| JP | A 11-23833 | 1/1999 |
| JP | A 2000-94707 | 4/2000 |
| JP | A 2000-127419 | 5/2000 |

* cited by examiner

*Primary Examiner*—K. Feggins
(74) *Attorney, Agent, or Firm*—Oliff & Berridge PLC

(57) ABSTRACT

A droplet discharge device is provided which can maintain predetermined liquid discharge characteristics even in the case where a drawing liquid of a high viscosity is used. A droplet discharge device which discharges liquid filled into a droplet discharge head, has a filling apparatus which switches between a first liquid and a second liquid of a lower viscosity than the first liquid, and fills the droplet discharge head.

45 Claims, 23 Drawing Sheets

Fig. 16A BLACK MATRICS FORMING STEP
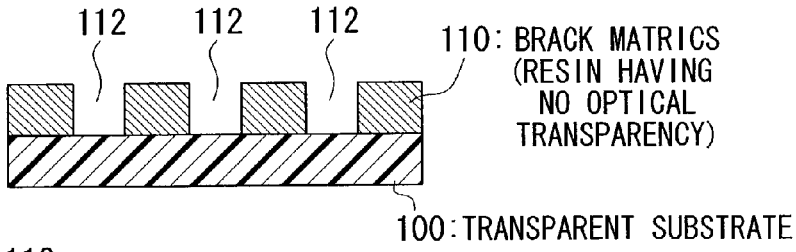
Fig. 16B
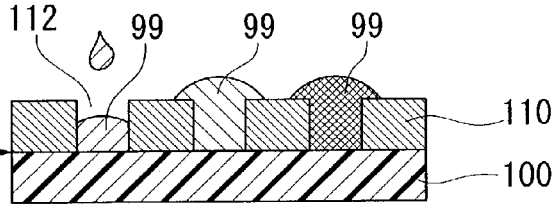
Fig. 16C
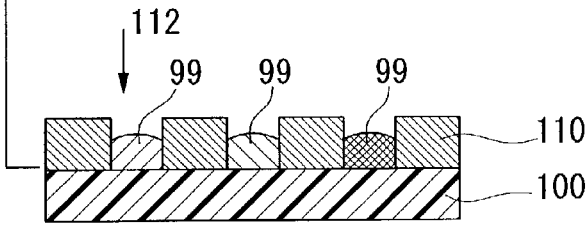
Fig. 16D
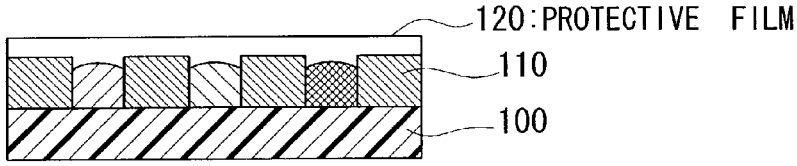
Fig. 16E
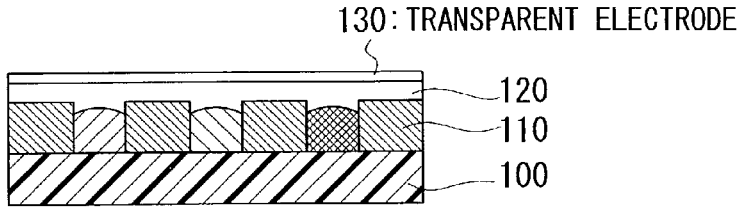
Fig. 16F
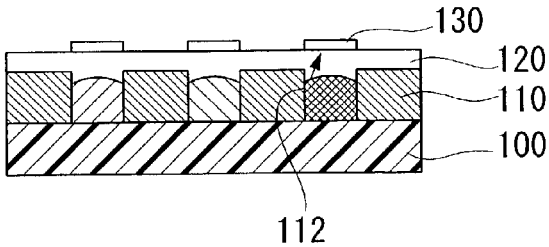

DROPLET DISCHARGE DEVICE AND LIQUID FILLING METHOD THEREFOR, AND DEVICE MANUFACTURING APPARATUS, DEVICE MANUFACTURING METHOD AND DEVICE

TECHNICAL FIELD

The present invention relates to a droplet discharge device and a liquid filling method, and a device manufacturing apparatus, a device manufacturing method and a device. For example the invention relates to a droplet discharge device used when manufacturing a color filter applicable to a display device such as a liquid crystal display, and a method of filling drawing liquid into a droplet discharge head in the droplet discharge device, and to a device manufacturing apparatus furnished with the droplet discharge device, a device manufacturing method, and a device.

BACKGROUND ART

With the development of electronic equipment such as for computers and portable information-processing equipment terminals, the use of liquid crystal display devices, in particular color liquid crystal display devices is increasing. This type of liquid crystal display device uses a color filter in order to color the display image. The color filter has a substrate, and is formed by impacting liquid of R (red), G (green), B (blue) in a predetermined pattern onto the substrate. As such a method of impacting liquid such as ink onto the substrate, a droplet discharge method (ink jet method) is adopted.

In the case where a droplet discharge method is adopted, a predetermined amount of drawing (film producing) liquid is discharged (ejected) from a droplet discharge head and impacted on the film. However this substrate, as disclosed for example in the following patent literature 1, is mounted onto an XY stage (a stage which can move freely in two dimensions along an XY plane). By moving the substrate in the X-direction and the Y-direction by means of this XY stage, liquid from a plurality of droplet discharge heads can be impacted on predetermined positions on the substrate.

Patent Literature 1: Japanese Unexamined Patent Application First Publication No. Hei 8-271724A (FIG. 5)

However, in the abovementioned background art, there are the following problems.

Regarding the liquid discharged from the droplet discharge head, liquid stored in a liquid tank is supplied to the droplet discharge head via a tube or the like to fill the head. However at the time of initial operation, or for example after being suspended for around one day, since the liquid is not filled into the head, it is necessary to introduce the liquid to as far as the droplet discharge head.

Therefore, heretofore, a method is often adopted which involves connecting a negative pressure suction mechanism such as a pump or tube constituting a suction drive source to a cap which covers the liquid discharge face of the droplet discharge head to prevent drying, and applying a negative pressure suction under conditions with the cap abutted against the droplet discharge head, to thereby introduce and fill a liquid from the liquid tank via the tube to the droplet discharge head.

In the case of a liquid of a relatively low viscosity used for a printer or the like, when the liquid is filled into the droplet discharge head, in most cases bubbles existing inside the droplet discharge head can be exhausted. However in the case where a liquid of a high viscosity is filled into the droplet discharge head, the bubbles cannot be completely discharged. If bubbles remain inside the head, a problem arises in that the liquid is not discharged, and even if discharged the speed and weight fluctuates, so that the discharge characteristics for the liquid are not stable. In particular, recently, there is a movement to widely adopt the droplet discharge device, not only for printers, but also for industrial use. Therefore, it has become highly desirable to develop a technique for filling a head so that even with a liquid of a high viscosity there are no residual bubbles.

Moreover, in the case where a high viscosity liquid is used in a droplet discharge head, in addition to the above mentioned problem of initial filling, there is a problem in that the nozzle apertures clog due to a thickening of the liquid during pausing of the discharge head.

DISCLOSURE OF INVENTION

The present invention takes into consideration the above mentioned problems, with the object of providing a droplet discharge device and a liquid filling method therefor, which can maintain predetermined liquid discharge characteristics even in the case where a film production liquid of a high viscosity is used, and a device manufacturing apparatus, a device manufacturing method and a device manufactured by this device manufacturing apparatus.

In order to achieve the abovementioned objects, the present invention adopts the following construction.

The droplet discharge device of the present invention is a droplet discharge device which discharges liquid filled into a droplet discharge head, and has a filling apparatus which switches between a first liquid and a second liquid of a lower viscosity than the first liquid, and fills the droplet discharge head.

As a result, in the droplet discharge device of the present invention, by first filling a low viscosity filling liquid into the droplet discharge head, bubbles inside the droplet discharge head can be discharged. Consequently, by substituting the filling liquid for the liquid, the liquid can be filled into the droplet discharge head in a condition where bubbles have been discharged. Therefore, even if the liquid is of a high viscosity, predetermined liquid discharge characteristics can be maintained without the occurrence of poor discharge of the liquid attributable to the presence of bubbles.

The filling apparatus may comprise: a liquid storage section for storing liquid for supply to the droplet discharge head, having a first storage section for storing the first liquid and a second storage section for storing the second liquid, a liquid supply path section which connects the droplet discharge head and the liquid storage section to form a liquid supply path to the droplet discharge head, with a tip side communicated with the droplet discharge head and a base side branched into a first branch path communicated with the first storage section, and a second branch path communicated with the second storage section, and a switching device which switches between supply of the first liquid from the first storage section and supply of the second liquid from the second storage section.

Preferably the first liquid and the second liquid are liquids of mutually different colors, and the liquid supply path section is formed with a transparent material at at least a portion of a branch point where the first branch path and the second branch path are joined. Furthermore, preferably this further has an optical sensor which detects liquid inside the liquid supply path section via the transparent portion of the branch point of the liquid supply path section.

Moreover, preferably the switching device has a first valve provided in the first branch path and a second valve provided in the second branch path.

Furthermore, preferably the first branch path is shorter than the second branch path.

Moreover, preferably the first branch path is thicker than the second branch path.

Furthermore, preferably the first liquid and the second liquid are liquids for which phase separation does not occur therebetween.

Moreover, preferably the second liquid is a solvent of the first liquid.

Furthermore, preferably the second liquid has a high wettability with respect to the material constituting the liquid flow path of the droplet discharge head.

Moreover, preferably the second liquid also serves as a cleaning solution used in cleaning of the droplet discharge head.

Furthermore, preferably the second liquid is a heated first liquid.

As a result, in the present invention, since the viscosity of the liquid is reduced by heating, then by filling the low viscosity liquid into the droplet discharge head, bubbles inside the droplet discharge head can be discharged. Then, after the bubbles have been discharged, the unheated liquid, that is the liquid of a temperature appropriate for the drawing process replaces the liquid serving as the filling liquid, thereby enabling the drawing liquid to be filled into the droplet discharge head in a condition where the bubbles have been discharged. Therefore even when the liquid is of a high viscosity, predetermined liquid discharge characteristics can be maintained without the occurrence of poor discharge of the liquid attributable to the presence of bubbles. Furthermore, even in the case where the heated liquid and the unheated liquid are not sufficiently substituted, since the constituents of the liquids are the same, an adverse affect on the drawing characteristics of the liquid can be prevented. Moreover precipitation of solids due to so called solvent shock can be prevented.

Furthermore, preferably the viscosity of the first liquid is from 10 mPa·s to 50 mPa·s.

Moreover, preferably the viscosity of the second liquid is less than 4 mPa·s.

Furthermore, preferably the liquid storage section has a third storage section for storing a third liquid of a lower viscosity than the first liquid and a higher viscosity than the second liquid, and the liquid supply path section has a third branch path with a tip side communicating with the droplet discharge head, and a base side communicating with the third storage section, and the switching device switches between supply of the first liquid from the first storage section, supply of the second liquid from the second storage section, and supply of the third liquid from the third storage section.

Moreover, preferably the switching device has a first valve provided in the first branch path, a second valve provided in the second branch path, and a third valve provided in the third branch path.

Furthermore, preferably the second liquid is a solvent of the third liquid, and the third liquid is a solvent of the first liquid.

Moreover, the present invention may adopt a configuration comprising a pressure device which pressurizes the liquid supplied to the droplet discharge head to fill the droplet discharge head.

Furthermore, a pressurizing condition for the liquid is preferably set based on the viscosity of the liquid to be supplied to the droplet discharge head.

Moreover, the present invention may adopt a configuration comprising a suction device which fills the liquid supplied to the droplet discharge head into the droplet discharge head by means of a negative pressure suction.

As a result, in the droplet discharge device of the present invention, since this sucks close to the droplet discharge head, then compared to for example the case of pressuring the liquid tank, pressure losses are minimal, and the liquid can be filled effectively. Moreover, by sucking on the droplet discharge head, solids and dirt adhered to the droplet discharge head can be easily removed.

Furthermore, preferably the suction device comprises a cap member which is pressed onto a nozzle forming face of the droplet discharge head to form a closed space with the nozzle forming face, and a suction pump which creates a negative pressure in the closed space.

Moreover, preferably at least a part of the cap member in contact with the liquid is liquid resistant.

Furthermore, preferably the droplet discharge device further has a temperature sensor which measures the ambient temperature of the droplet discharge device, and a suction amount of the suction pump is controlled in accordance with the ambient temperature measured by the temperature sensor.

Moreover, preferably suction conditions for the liquid are set based on the viscosity of the liquid to be supplied to the droplet discharge head.

Furthermore, preferably there is further provided a laser device which detects droplets discharged from a nozzle opening formed in the droplet discharge head.

Moreover, the droplet discharge device of the present invention may adopt a configuration which has a de-gassifier which de-gasses the liquid supplied to the droplet discharge head before filling into the droplet discharge head.

As a result, in the droplet discharge device of the present invention, the situation where bubbles are not present immediately after filling a liquid into the droplet discharge head, but with the elapse of time bubbles are generated from the liquid, can be prevented. Furthermore, even if by chance, some bubbles remain inside the droplet discharge head, the liquid absorbs these bubbles. Therefore an adverse effect on the discharge characteristics of the liquid can be prevented.

Moreover, in the droplet discharge device of the present invention, preferably the construction has a control device which controls the filling apparatus so that after the discharge process of the first liquid, the first liquid which has been filled into the droplet discharge head is again replaced by the second liquid.

As a result, in the droplet discharge device of the present invention, by keeping the droplet discharge head in a condition of being filled by the second liquid after the discharge process, then a rapid drying liquid can also be used.

Furthermore, the device manufacturing apparatus of the present invention is a device manufacturing apparatus having a droplet discharge device which impacts liquid discharged from a droplet discharge head onto a substrate to perform a film production process on the substrate, wherein the above mentioned droplet discharge device is used as the droplet discharge device.

As a result, since the device manufacturing apparatus of the present invention can discharge a liquid in a condition where predetermined liquid discharge characteristics are maintained, then by executing a predetermined film production process, device characteristics (quality) can be ensured.

Moreover, the present invention may adopt a configuration wherein a plurality of liquids of different types are respectively used as the first liquid, and each liquid is discharged to respectively produce a film on the substrate.

In this case, a plurality of types of liquid of a high viscosity can be produced in a film on the substrate with a single apparatus, and hence production efficiency can be improved.

Furthermore, the device of the present invention is manufactured by the above mentioned device manufacturing apparatus.

As a result, in the device of the present invention, a predetermined quality can be ensured by executing the film production process with predetermined liquid discharge characteristics.

On the other hand, a liquid filling method for a droplet discharge device of the present invention, is a method for filling a first liquid into a droplet discharge head of a droplet discharge device which discharges a liquid filled into the droplet discharge head, and comprises the steps of: filling a second liquid of a lower viscosity than the first liquid into the droplet discharge head; and replacing the second liquid which has been filled into the droplet discharge head with the first liquid.

As a result, in the liquid filling method for the droplet discharge device of the present invention, by first filling the second liquid of a low viscosity into the droplet discharge head, bubbles inside the droplet discharge head can be discharged. Accordingly, by replacing the second liquid with the first liquid, the first liquid can be filled into the droplet discharge head in a condition where the bubbles have been discharged. Therefore even if the first liquid is of a high viscosity, poor discharge of the first liquid attributable to the presence of bubbles does not occur, and predetermined liquid discharge conditions can be maintained.

The present invention may also adopt a procedure which includes a step for again replacing the first liquid which has been filled into the droplet discharge head and filling with the second liquid after a discharge process for the first liquid.

As a result, the present invention can also use a rapid drying liquid, by keeping the droplet discharge head in a condition filled with the second liquid after a film production process.

Moreover, preferably the droplet discharge device comprises: a liquid storage section for storing liquid for supply to the droplet discharge head, having a first storage section for storing the first liquid and a second storage section for storing the second liquid, and a liquid supply path section which connects the droplet discharge head and the liquid storage section to form a liquid supply path to the droplet discharge head, with a tip side communicated with the droplet discharge head and a base side branched into a first branch path communicated with the first storage section, and a second branch path communicated with the second storage section, and in a condition where liquid is not filled to inside of the droplet discharge head, the first liquid is supplied from the first storage section and the first liquid is filled to inside the liquid supply path portion up until a branch point where the first branch path and the second branch path are joined, and supply of the first liquid from the first storage section is stopped, and the second liquid is supplied from the second storage section to fill the second liquid to inside the liquid discharge head, and supply of the second liquid from the second storage section is stopped, and the first liquid is supplied from the first storage section, and while discharging the second liquid filled to inside the droplet discharge head and the liquid supply path, from a nozzle opening formed in the droplet discharge head, the first liquid is introduced to the droplet discharge head, and the second liquid inside the droplet discharge head is replaced by the first liquid, and the first liquid is filled to inside the droplet discharge head.

Furthermore, preferably the first liquid and the second liquid are liquids of mutually different colors, and the liquid supply path section is formed with a transparent material at at least a portion of the branch point where the first branch path and the second branch path are joined, and there is further provided an optical sensor which detects liquid inside the liquid supply path section via the transparent portion of the branch point of the liquid supply path section, and when the first liquid is filled to inside the liquid supply path section up to the branch point, if detected by the sensor that the liquid has reached to the branch point, supply of the first liquid from the first storage section is stopped.

Moreover, the liquid storage section has a third storage section for storing a third liquid of a lower viscosity than the first liquid and a higher viscosity than the second liquid, and the liquid supply path section has a third branch path with a tip side communicating with the droplet discharge head, and a base side communicating with the third storage section, and in a condition where liquid is not filled to inside the droplet discharge head, the first liquid is supplied from the first storage section, and if the first liquid reaches to the branch point where the first branch path, the second branch path and the third branch path are joined, supply of the first liquid from the first storage section is stopped, while on the other hand, if the third liquid is supplied from the third storage section and the third liquid reaches to the branch point, supply of the third liquid from the third storage section is stopped, and the second liquid is supplied from the second storage section via the liquid supply path section to the droplet discharge head, and the second liquid fills to inside of the droplet discharge head, and supply of the second liquid from the second storage section is stopped and the third liquid is supplied from the third storage section, and while discharging the second liquid filled to inside the droplet discharge head and the liquid supply path section, from the nozzle opening of the droplet discharge head, the third liquid is introduced to the droplet discharge head, and the second liquid inside the droplet discharge head is replaced by the third liquid, and the third liquid is filled to inside the droplet discharge head, and supply of the third liquid from the third storage section is stopped and the first liquid is supplied from the first storage section, and while discharging the third liquid filled to inside the droplet discharge head and the liquid supply path section, from the nozzle opening of the droplet discharge head, the first liquid is introduced to the droplet discharge head, and the third liquid inside the droplet discharge head is replaced by the first liquid, and the first liquid is filled to inside the droplet discharge head.

Furthermore, the present invention may adopt a procedure where supply of liquid from the liquid storage section is performed by pressurizing the liquid.

In this case, preferably the pressurizing conditions for the liquid are set based on the viscosity of the liquid to be supplied to the droplet discharge head.

Moreover, the present invention may adopt a procedure where supply of the liquid from the liquid storage section is performed by making a closed space formed by pressing a cap member against a nozzle forming face of the droplet discharge head, a negative pressure.

Furthermore, preferably a negative pressure suction condition for the liquid is set based on the viscosity of the liquid to be supplied to the droplet discharge head.

Moreover, preferably the droplet discharge device comprises: a liquid storage section for storing a liquid for supply to the droplet discharge head, having a first storage section for storing the first liquid, and a second storage section for storing the second liquid, and a liquid supply path section which connects the droplet discharge head and the liquid storage section to form a liquid supply path to the droplet discharge head, with a tip side communicated with the droplet discharge head and a base side branched into a first branch path communicated with the first storage section, and a second branch path communicated with the second storage section, and after performing a predetermined operation of discharging the first liquid from the droplet discharge head, supply of the first liquid from the first storage section to the droplet discharge head is stopped, and the second liquid is supplied from the second storage section, and while discharging the first liquid filled to inside the droplet discharge head and the liquid supply path portion, from a nozzle opening formed in the droplet discharge head, the second liquid is introduced to the droplet discharge head, and the first liquid inside the droplet discharge head is replaced by the second liquid, and the second liquid is filled to inside the droplet discharge head.

Moreover, the present invention preferably has a step for de-gassing the liquid supplied to the droplet discharge head before filling into the droplet discharge head.

As a result, in the present invention, the situation where bubbles are not present immediately after filling a liquid into the droplet discharge head, but with the elapse of time bubbles are generated from the liquid, can be prevented. Furthermore, even if by chance, some bubbles remain inside the droplet discharge head, the liquid absorbs these bubbles. Therefore an adverse effect on the discharge characteristics of the liquid can be prevented.

Furthermore, preferably the first liquid and the second liquid are liquids for which phase separation does not occur therebetween.

Moreover, preferably the second liquid is a solvent of the first liquid. For example, by filling a low viscosity solvent component into the droplet discharge head as the second liquid, bubbles inside the droplet discharge head can be discharged. Then, after discharging the bubbles, by substituting the first liquid for the solvent component serving as the second liquid, the film production liquid can be filled into the droplet discharge head in a condition where the bubbles have been discharged. Therefore, even if the first liquid is of a high viscosity, predetermined liquid discharge characteristics can be maintained without the occurrence of poor discharge of the first liquid attributable to the presence of bubbles. Furthermore, even in the case where the solvent component and the first liquid are not sufficiently substituted, since the solvent component constitutes a part of the first liquid, an adverse affect on the film producing characteristics of the first liquid can be prevented. Moreover precipitation of solids due to so called solvent shock can be prevented. Furthermore, even in the case where solid constituents of the first liquid remain inside the droplet discharge head, these solid constituents can be dissolved by the second liquid.

Preferably, the construction is such that the second liquid is a heated h first liquid. In this case, since the viscosity of the liquid is reduced by heating, then by filling the low viscosity second liquid into the droplet discharge head, bubbles inside the droplet discharge head can be discharged. Then, after the bubbles have been discharged, the unheated liquid, that is the first liquid of a temperature appropriate for the film production replaces the second liquid, thereby enabling the film production liquid to be filled into the droplet discharge head in a condition where the bubbles have been discharged. Therefore even when the first liquid is of a high viscosity, predetermined liquid discharge characteristics can be maintained without the occurrence of poor discharge of the liquid attributable to the presence of bubbles. Furthermore, even in the case where the heated liquid and the unheated liquid are not sufficiently substituted, since the constituents of the liquids are the same, an adverse affect on the drawing characteristics of the liquid can be prevented. Moreover precipitation of solids due to so called solvent shock can be prevented.

Furthermore, preferably the viscosity of the first liquid is from 10 mPa·s to 50 mPa·s.

Moreover, preferably the viscosity of the second liquid is less than 4 mPa·s.

Furthermore, the device manufacturing method of the present invention is a method of manufacturing a device using a droplet discharge device having a droplet discharge head which discharges a liquid, and comprises a step for filling the liquid into the droplet discharge head using the above liquid filling method.

As a result, since by using the device manufacturing method of the present invention, liquid can be discharged in a condition where predetermined liquid discharge characteristics are maintained, device characteristics (quality) can be ensured by executing a predetermined drawing process.

It is also possible to adopt a procedure where a plurality of liquids of different types are respectively used as the first liquid, and each liquid is discharged to respectively produce a film on the substrate.

In this case, a plurality of types of liquid of a high viscosity can be produced in a film on the substrate with a single apparatus, and hence production efficiency can be improved.

BRIEF DESCRIPTION OF THE DRAWINGS

FIGS. 16A to 16F are diagrams showing examples of manufacturing a color filter using a substrate.

BEST MODE FOR CARRYING OUT THE INVENTION

Hereunder is a description of a first embodiment of a droplet discharge device and a liquid filling method therefor, and a device manufacturing apparatus, a device manufacturing method and a device according to the present invention, with reference to FIGS. 1 to 4F.

Figure 1:
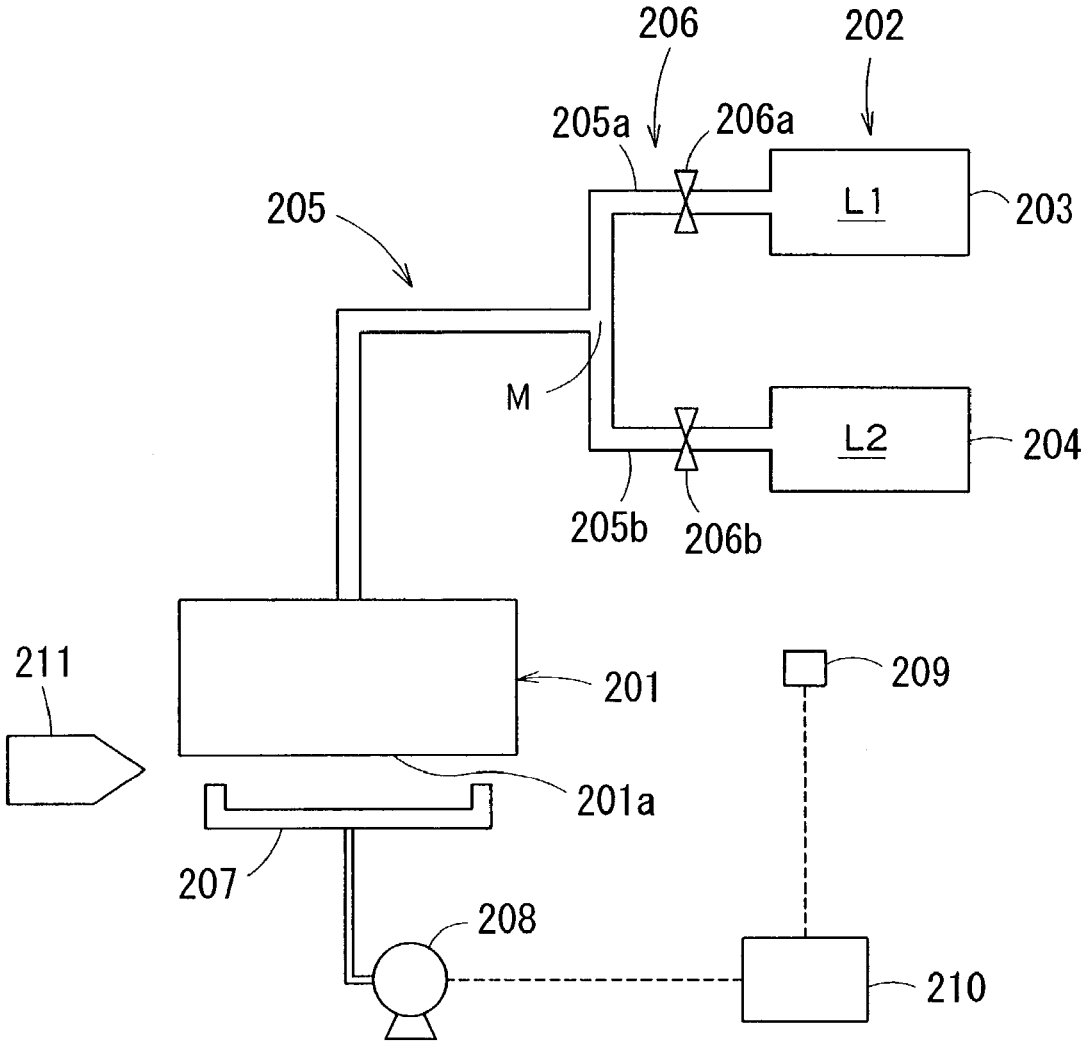
FIG. 1 is a view showing a first embodiment of the present invention, being a schematic diagram of a droplet discharge device.

As shown in FIG. 1, the droplet discharge device (liquid injection device) according to the embodiment has a head section (droplet discharge head) 201 formed with a plurality of nozzle openings which discharge (inject) droplets. The head section 201 has a plurality of pressure generating elements which pressurize liquid inside a plurality of pressure chambers formed on the inside, to eject droplets from the plurality of nozzle openings. Detailed construction of the head section 201 will be described later.

The droplet discharge device further comprises a liquid storage section 202 which stores a liquid for supply to the head section 201. The liquid storage section 202 has a high viscosity liquid storage section (first storage section 203) which stores a high viscosity liquid (first liquid) L1, and a low viscosity liquid storage section (second storage section) 204 which stores a low viscosity liquid (second liquid) L2 of a lower viscosity than the high viscosity liquid L1.

The high viscosity liquid L1 is a liquid which is used at the time of manufacturing for example a liquid crystal display using the droplet discharge device. On the other hand, the low viscosity liquid L2 is an auxiliary liquid used for filling the high viscosity liquid L1 into the head section 201 of the droplet discharge device. The viscosity of the high viscosity liquid L1 is typically from 10 mPa·s to 50 mPa·s. The viscosity of the low viscosity liquid L2 is typically not more than 4 mPa·s.

Between the head section 201 and the liquid storage section 202 is connected by a liquid supply pipe (liquid supply path section) 205 which forms a liquid supply path from the liquid storage section 202 to the head section 201. The liquid supply pipe 205 has a tip end side thereof communicated with the head section 201 and a base side branched from a branch point M into a first branch path 205*a* and a second branch path 205*b*, respectively communicated with the high viscosity liquid storage section 203 and the low viscosity liquid storage section 204.

Preferably, the first branch path 205*a* is shorter than the second branch path 205*b*, and the first branch path 205*a* is thicker than the second branch path 205*b*. By making the flow resistance for the high viscosity liquid L1 in the first branch path 205*a* smaller in this way, flow of the high viscosity liquid L1 can be made smooth.

Moreover, the droplet discharge device comprises a switching device 206 which switches between supply of the high viscosity liquid L1 from the high viscosity liquid storage section 203 and supply of the low viscosity liquid L2 from the low viscosity liquid storage section 204. The switching device 206 has a first valve 206*a* and second valve 206*b* respectively provided in the first branch path 205*a* and the second branch path 205*b*. The liquid storage section 202, the liquid supply pipe 205 and the switching device 206 constitute the filling apparatus according to the present invention.

Furthermore, the droplet discharge device has a suction device comprising a cap member 207 arranged at a position corresponding to a home position of the head section 201, and a suction pump 208 connected to the cap member 207. For the cap member 207 and the suction pump 208, a device similar to the device provided in a conventional ink jet recording device for sealing the head when unused, or for head cleaning and so forth may be used.

Figure 2:
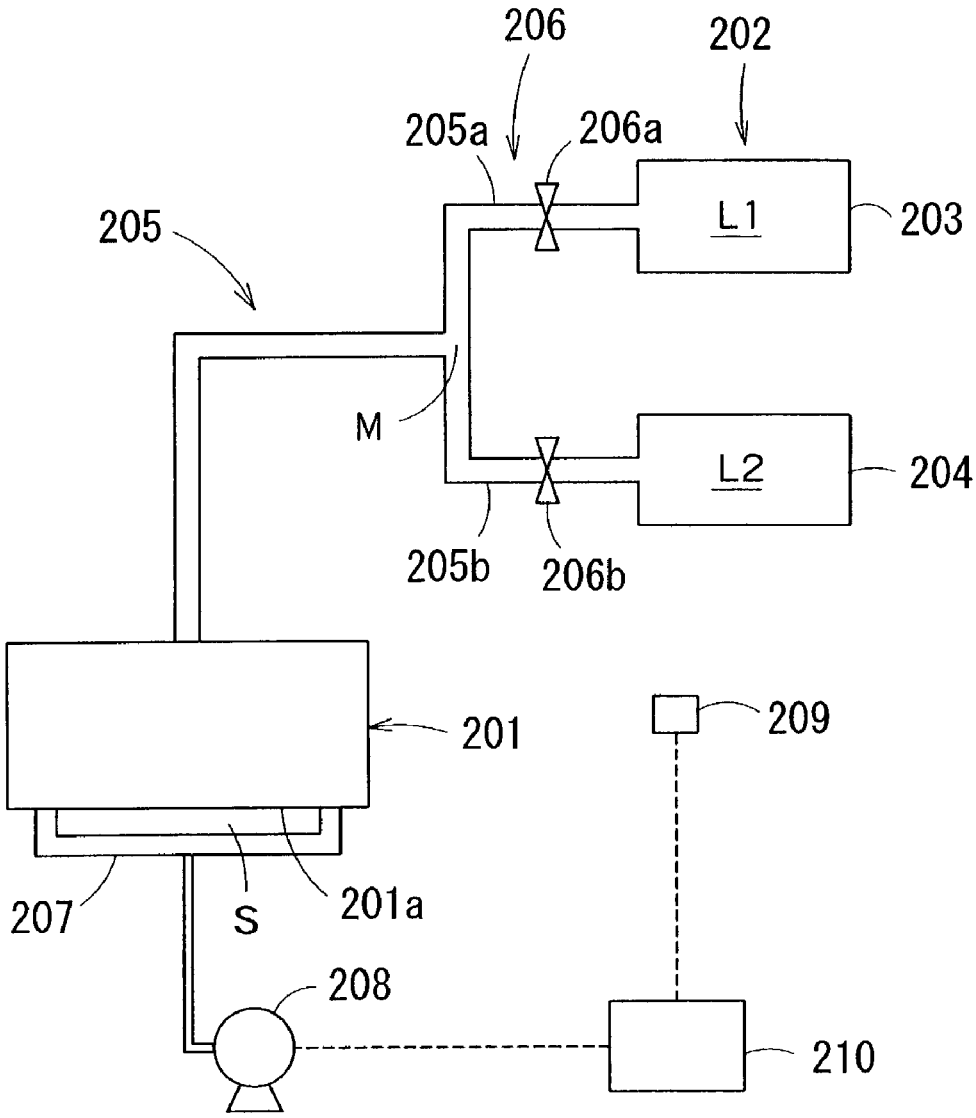
FIG. 2 shows a condition where, in the droplet discharge device shown in FIG. 1, a nozzle forming face of a head section is blocked by a cap member.

As shown in FIG. 2, the cap member 207 is pressed against a nozzle forming face 201*a* of the head section 201 which has moved to the home position, so that a closed space S is formed with the nozzle forming face 201*a*. Then, the closed space S is made a negative pressure by the suction pump 208 so that air and liquid inside the head section 201 can be sucked out from the nozzle openings of the head section 201.

At least the portion of the cap member 207 in contact with the high viscosity liquid L1 and the low viscosity liquid L2 is liquid resistant. Therefore, the cap member 207 is not corroded by the high viscosity liquid L1 and the low viscosity liquid L2.

Moreover, the cap member 207 also functions as a lid for preventing drying of the nozzle openings of the head section 201, while the droplet discharge device is paused. Furthermore, this also functions as a liquid receiver at the time of a flushing operation which applies a drive signal for air discharge to the pressure generating element of the head section 201 to air discharge droplets. Moreover this also functions as a cleaning mechanism which cleans the head section 201 by applying a negative pressure from the suction pump 208 to the head section 201 to suck out the liquid.

Furthermore, the droplet discharge device further has a temperature sensor 209 for measuring the ambient temperature. A detection signal from the temperature sensor 209 is sent to a control unit 210. Then, the control unit 210 controls the suction amount of the suction pump 208 corresponding to the ambient temperature measured by the temperature sensor 209. Since the viscosity of the high viscosity liquid L1 and the low viscosity liquid L2 changes with temperature, then by controlling the suction amount of the suction pump 208 corresponding to the ambient temperature measured by the temperature sensor 209, the high viscosity liquid L1 and the low viscosity liquid L2 can be sucked without excess or deficiency.

Moreover, the droplet discharge device further comprises a laser unit 211 which detects droplets ejected from the nozzle opening of the head section 201. By detecting droplets ejected from the head section 201 with the laser unit 211, it is possible to confirm that air inside the head section 201 has been completely exhausted and no bubbles remain.

Figure 3:
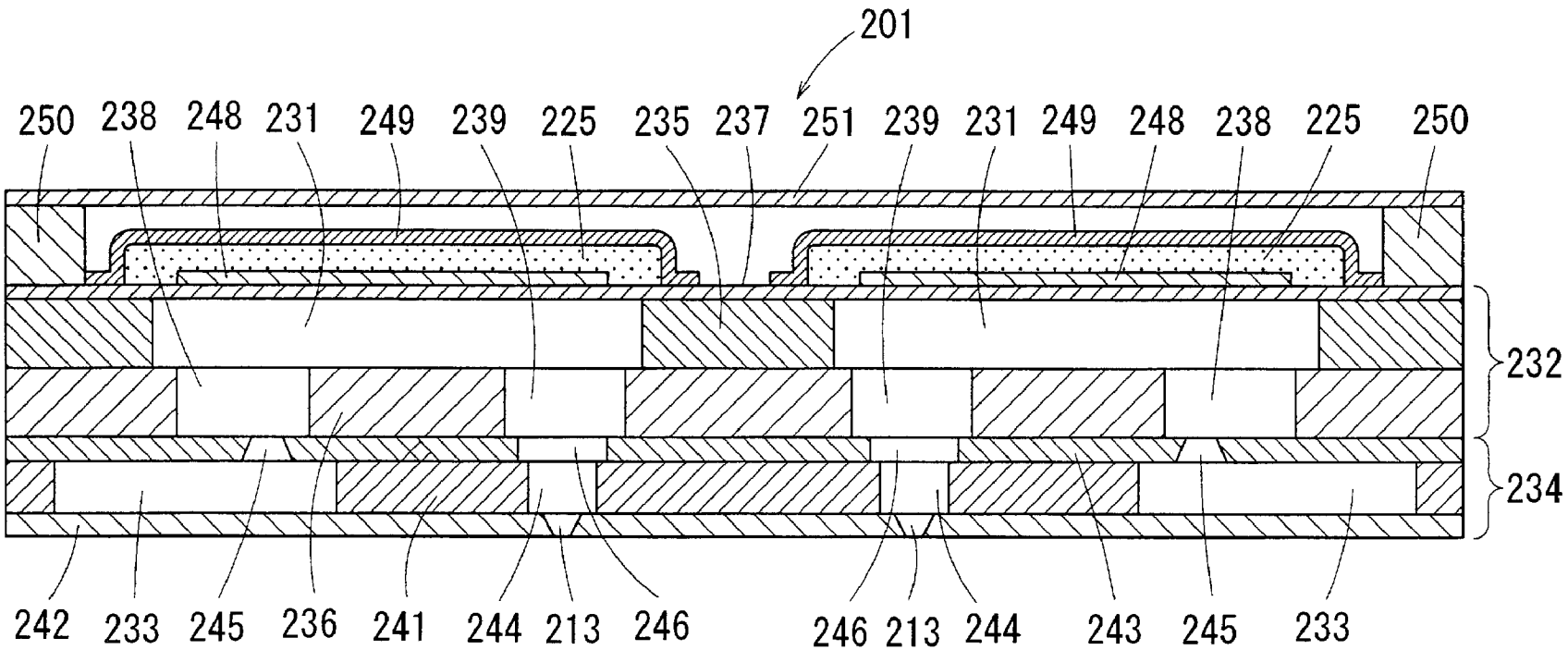
FIG. 3 is a cross-section showing a detailed construction of the head section of the droplet discharge device shown in FIG. 1.

FIG. 3 shows a detailed construction of the head section of the droplet discharge device shown in FIG. 1. This head section 201 is one which uses a flexural oscillation mode piezoelectric vibrator 225. The head section 201 comprises an actuator unit 232 containing a plurality of pressure chambers 231 and a plurality of piezoelectric vibrators 225, and a passage unit 234 formed with nozzle openings 213 and common liquid chambers 233. Furthermore, the passage unit 234 is joined to the front side of the actuator unit 232.

The pressure chambers 231 expand and contract with the deformation of the piezoelectric vibrators 225, and the liquid pressure inside the pressure chambers 231 changes accompanying this. Then, due to the change in the liquid pressure inside the pressure chambers 231, droplets are discharged from the nozzle openings 213. For example, by suddenly contracting the pressure chambers 231, the interior of the pressure chambers 231 is pressurized, and droplets are discharged from the nozzle openings 213.

The actuator unit 232 includes; a pressure chamber forming substrate 235 on which is formed a space for forming the pressure chambers 231, lid members 236 joined to the front face of the pressure chamber forming substrate 235, a diaphragm 237 connected to the rear face of the pressure chamber forming substrate 235 and covering an open face of the space, and the piezoelectric vibrators 225. In the lid members 236 is formed first liquid passages 238 for communicating between the common liquid chambers 233 and the pressure chambers 231, and second liquid passages 239 for communicating between the pressure chambers 231 and the nozzle openings 213.

The passage unit 234 comprises; a liquid chamber forming substrate 241 in which is formed cavities for forming the common liquid chambers 233, a nozzle plate 242 pierced with a plurality of nozzle openings 213, and joined to the front face of the liquid chamber forming substrate 241, and a supply port forming plate 243 joined to a rear face of the liquid chamber forming substrate 241.

In the liquid chamber forming substrate 241 is formed nozzle communication ports 244 which communicate with the nozzle openings 213. Furthermore, in the supply port forming plate 243 is piercingly provided liquid supply ports 245 which communicate between the common liquid chambers 233 and the first liquid passages 238, and communicating ports 246 which communicate between the nozzle communication ports 244 and the second liquid passages 239.

Consequently, in the head section 201 is formed a set of liquid passages from the common liquid chambers 233 through the pressure chambers 231 to the nozzle openings 213.

The piezoelectric vibrators 225 are formed on the opposite side of the pressure chambers 231 with the diaphragm 237 therebetween. The piezoelectric vibrators 225 are a flat plate shape, with lower electrodes 248 formed on the front faces of the piezoelectric vibrators 225, and upper electrodes 249 formed on the rear faces so as to cover the piezoelectric vibrators 225.

Furthermore, on opposite end portions of the actuator unit 232, the base end portions are formed with joining terminals 250 for conducting to the upper electrodes 249 of the piezoelectric vibrators 225. The tip end faces of the joining terminals 250 are formed higher than the piezoelectric vibrators 225. Furthermore, a flexible circuit board 251 is joined to the tip end faces of the joining terminals 250, and a drive pulse is supplied to the piezoelectric vibrators 225 via the joining terminals 250 and the upper electrodes 249.

The pressure chambers 231, the piezoelectric vibrators 225 and the joining terminals 250 are respectively shown as only two in the figure. However these are multiply provided corresponding to the nozzle openings 213.

In the head section 201, when a drive pulse is input, a voltage differential is produced between the upper electrode 249 and the lower electrode 248. Due to this voltage differential, the piezoelectric vibrator 225 contracts in a direction orthogonal to the electric field. At this time, the lower electrode 248 side of the piezoelectric vibrator 225 joined to the diaphragm 237 does not contract, and only the upper electrode 249 side contracts. Therefore the piezoelectric vibrator 225 and the diaphragm 237 bend so as to protrude to the pressure chamber 231 side, and the volume of the pressure chamber 231 is contracted.

Then, in the case where a droplet is to be discharged from the nozzle opening 213, for example the pressure chamber 231 is rapidly contracted. That is to say, when the pressure chamber 231 is rapidly contracted, an increase in liquid pressure is produced inside the pressure chamber 231, and a droplet is discharged from the nozzle opening 213 following this pressure rise. Moreover, when after discharge of the droplet, the voltage differential between the upper electrode 249 and the lower electrode 248 disappears, the piezoelectric vibrator 225 and the diaphragm 237 return to their original positions. As a result, the interior of the contracted pressure chamber 231 expands, and liquid is supplied from the common liquid chamber 233 via the liquid supply port 245 to the pressure chamber 231.

Next is a description of a method for filling liquid into the head section 201 in the droplet discharge device according to the present embodiment.

Figure 4A:
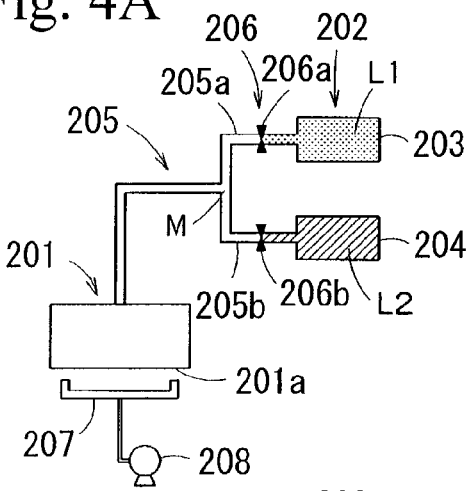
FIGS. 4A to 4F are diagrams for sequentially explaining a method of filling a liquid into the head section in the droplet discharge device shown in FIG. 1.

FIG. 4A shows a condition before liquid is filled to inside the head section 201. Moreover, this shows the condition before the cap member 207 is pressed against the nozzle forming face 201*a* of the head section 201. The first valve 206*a* and the second valve 206*b* are both in the closed condition, and the high viscosity liquid L1 and the low viscosity liquid L2 are respectively filled to inside of the first branch path 205*a* and the second branch path 205*b* up to before the first valve 206*a* and the second valve 206*b*.

Figure 4B:
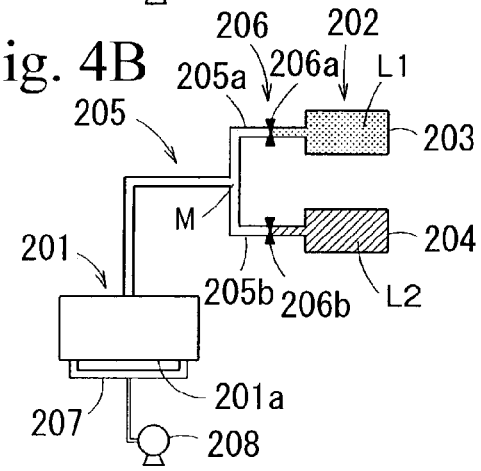
Figure 4C:
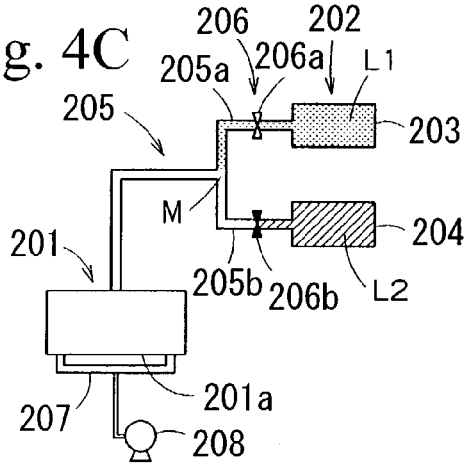

Next, as shown in FIG. 4B, the cap member 207 is pressed against the nozzle forming face 201*a* of the head section 201. In this condition, the closed space S is made a negative pressure by the suction pump 208, and as shown in FIG. 4C, the first valve 206*a* is opened, and the interior of the first branch path 205*a* past the first valve 206*a* is filled with the high viscosity liquid L1. Then, at the point in time when the high viscosity liquid L1 reaches the position of the branch point M, the first valve 206*a* is closed.

As a means for confirming the time when the high viscosity liquid LI has reached the junction point M, there is a visual confirmation means which involves constructing the liquid supply pipe 205 from transparent piping.

Figure 4D:
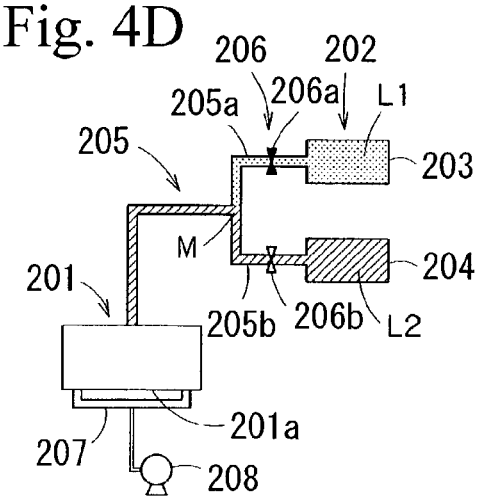

Next, as shown in FIG. 4D, the second valve 206*b* is opened, with the first valve 206*a* remaining in the closed condition, so that the whole of the liquid supply pipe 205 excluding the first branch path 205*a* is filled with the low viscosity liquid L2. Furthermore, the interior of the liquid supply path of the head section 201 is also filled with the low viscosity liquid L2.

Figure 4E:
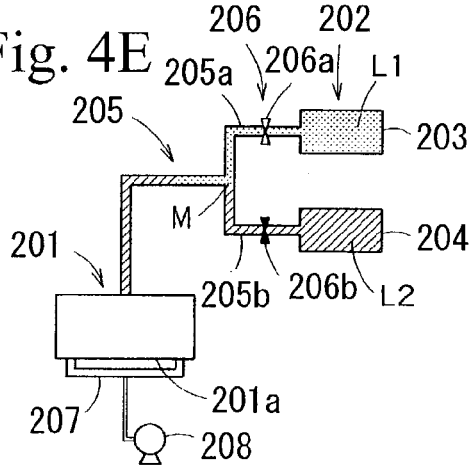

Next, as shown in FIG. 4E, the second valve 206*b* is closed and the first valve 206*a* is opened, and while the low viscosity liquid L2 is being discharged from the nozzle opening of the head section 201, the high viscosity liquid L1 is supplied to inside the liquid supply pipe 205. As a result, the low viscosity liquid L2 which has filled to the downstream side of the branch point M of the liquid supply pipe 205 is gradually replaced by the high viscosity liquid L1 from the branch point M towards the head section 201.

Figure 4F:
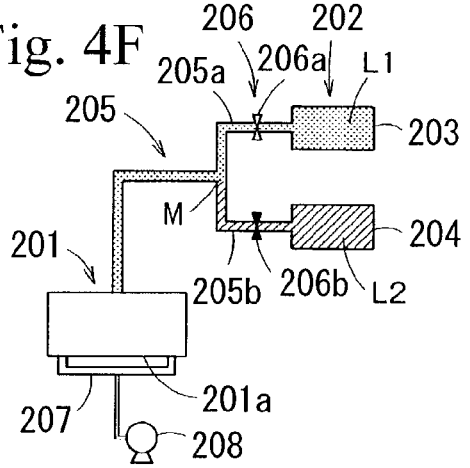

Then, finally, as shown in FIG. 4F, the interior of the head section 201 and all of the liquid supply pipe 205 with the exception of the second branch path 205*b*, are filled with the high viscosity liquid L1.

In this way, filling of the high viscosity liquid L1 into the head section 201 of the droplet discharge device is performed.

Next, after completion of a predetermined operation such as ejecting the high viscosity liquid L1 from the head section 201 of the droplet discharge device to produce a color filter for a liquid crystal display, the first valve 206*a* is closed and the second valve 206*b* is opened, and the nozzle forming face 201*a* of the head section 201 is sealed with the cap member 207 to apply a negative pressure.

As a result, with supply of the high viscosity liquid L1 from the high viscosity liquid storage section 203 in a stopped condition, the low viscosity liquid L2 is supplied from the low viscosity liquid storage section 204. Then the high viscosity liquid L1 which is filled to inside of the liquid supply pipe 205 is discharged from the plurality of nozzle openings of the head section 201, and the low viscosity liquid L2 is introduced to the head section 201, so that the high viscosity liquid L1 inside the head section 201 is replaced by the low viscosity liquid L2 and the low viscosity liquid L2 is filled into the interior of the head section 201.

In the above mentioned head filling process, the control unit 210 controls the suction amount of the suction pump 208 corresponding to the ambient temperature measured by the temperature sensor 209, so that the high viscosity liquid L1 and the low viscosity liquid L2 are sucked without excess or deficiency.

In the present embodiment as described above, the high viscosity liquid L1 and the low viscosity liquid L2 can be selectively supplied to the head section 201, and at the time of the initial filling of the liquid into the head section 201, first of all the low viscosity liquid L2 is supplied to the head section 201, after which the supplied low viscosity liquid L2 can be replaced by the high viscosity liquid L1. Therefore the high viscosity liquid L1 can be reliably filled without residual bubbles, into the interior of liquid passages having a complicated construction formed in the head section 201.

Furthermore, on completion of predetermined processing using the droplet discharge device, the high viscosity liquid L1 inside the head section 201 can be discharged and replaced by the low viscosity liquid L2. Therefore even in the case of reusing the droplet discharge device after an idle period, clogging or the like of the liquid inside the head section 201 can be prevented.

Figure 5:
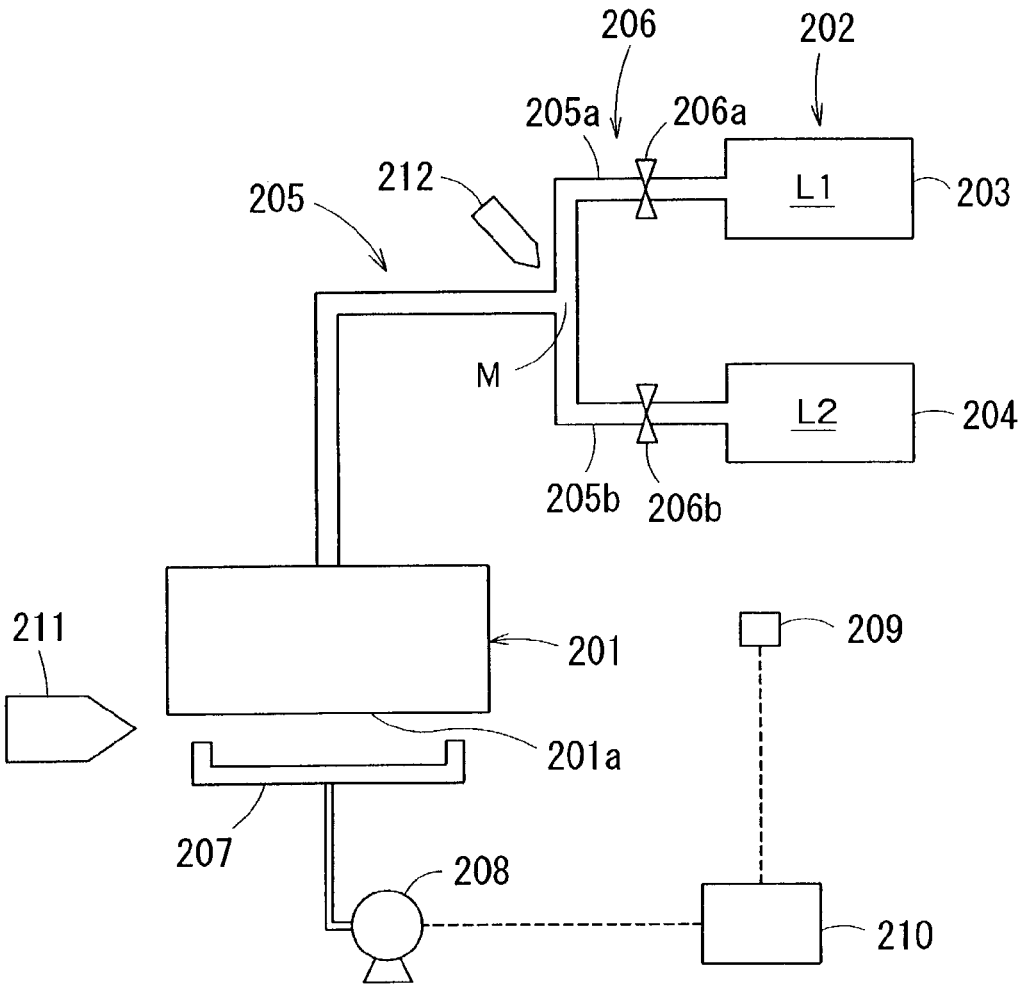
FIG. 5 shows a second embodiment of the present invention, being a schematic diagram of a droplet discharge device having an optical sensor.
Figure 6:
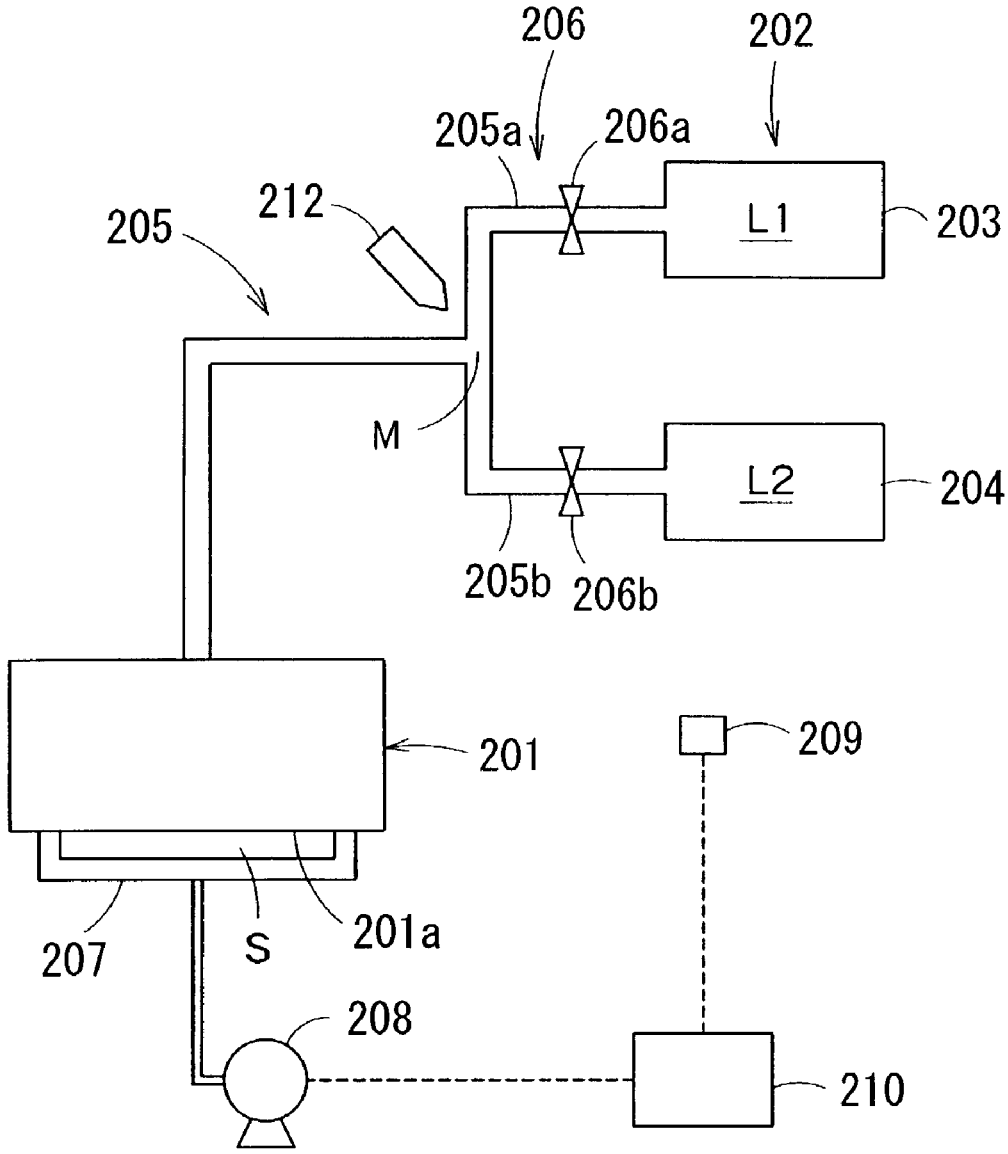
FIG. 6 shows a condition where, in the droplet discharge device shown in FIG. 5, a nozzle forming face of a head section is blocked by a cap member.

FIG. 5 and FIG. 6 show a second embodiment of the present invention.

In these figures, component the same as the constituent components of the first embodiment shown in FIG. 1 through FIG. 4F are denoted by the same reference symbols and the description thereof is omitted.

In this embodiment, the high viscosity liquid L1 and the low viscosity liquid L2 are liquids of mutually different colors. Moreover, preferably the two liquid L1 and L2 are liquids for which phase separation does not occur therebetween. Furthermore, preferably, the low viscosity liquid L2 is a solvent of the high viscosity liquid L1. Moreover, preferably the low viscosity liquid L2 has a high wettability which respect to material constituting the liquid flow path of the head section 201. Furthermore, preferably the low viscosity liquid L2 also serves as a cleaning solution used in cleaning the head section 201.

Moreover, for the liquid supply pipe 205, at least the portion of the branch point M is formed with a transparent material. Consequently, it is possible to confirm visually or with an optical sensor 212, whether or not the high viscosity liquid L1 or the low viscosity liquid L2 has reached the position of the branch point M.

Other construction is the same as that of the first embodiment.

In the droplet discharge device of the above construction, in addition to obtaining the same operation and effect as for the first embodiment, as shown in FIG. 4C in a condition with the first valve 206*a* open, the interior of the first branch path 205*a* past the first valve 206*a* is filled with the high viscosity liquid L1, and at the point in time when the high viscosity liquid L1 reaches the position of the branch point M, the first valve 206*a* is closed. However, here the point in time when the high viscosity liquid L1 reaches the branch point M can be confirmed by the optical sensor 212 via the transparent portion of the branch point M. Consequently, in this embodiment, compared to the case of visual confirmation, labor saving is possible which can contribute to a reduction in costs.

Figure 7:
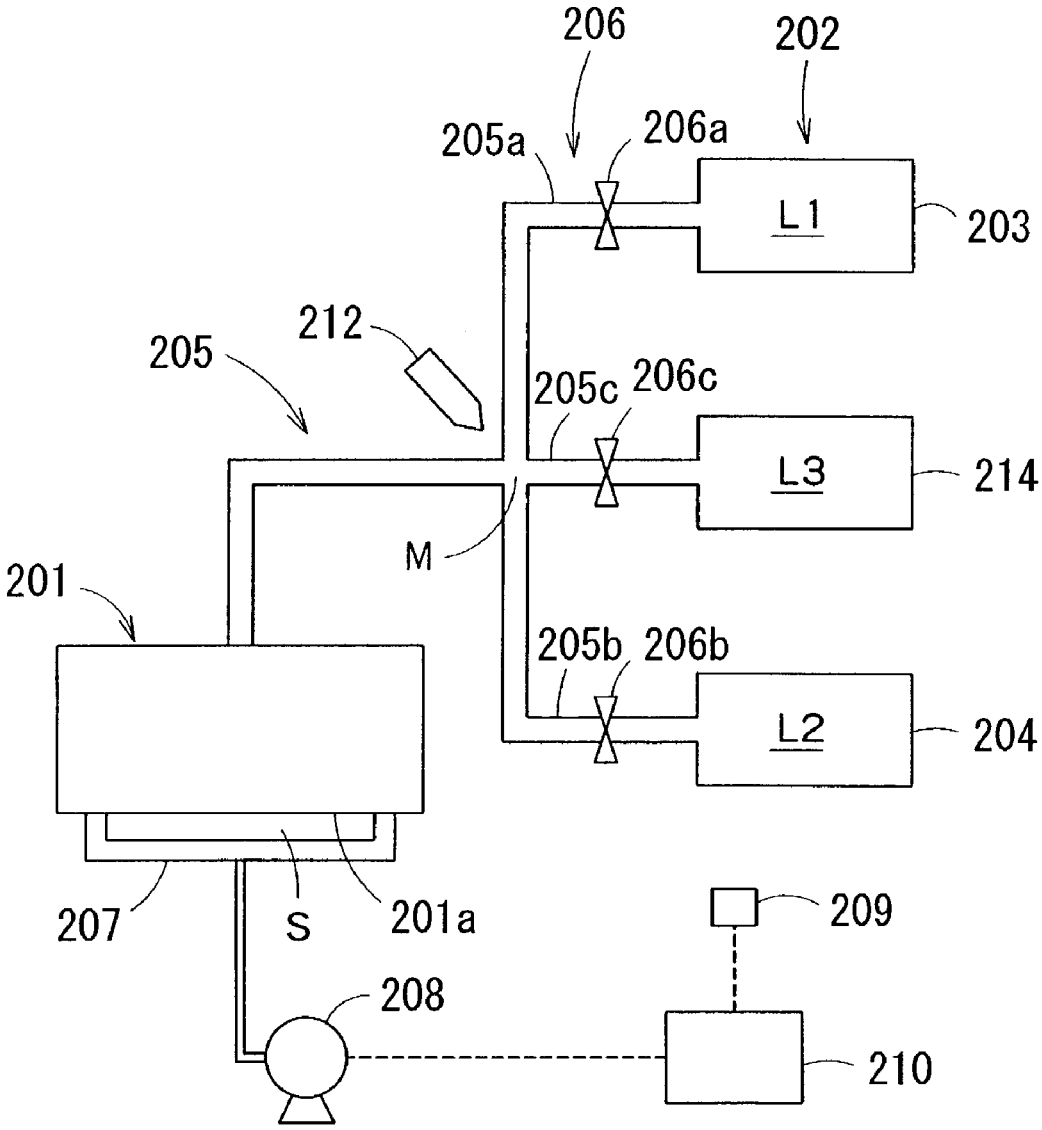
FIG. 7 shows a third embodiment of the present invention, being a schematic diagram of a droplet discharge device having an intermediate viscosity liquid storage section.

FIG. 7 shows a third embodiment of the present invention.

In this figure, components the same as the constituent elements of the second embodiment shown in FIG. 5 and FIG. 6 are denoted by the same reference symbols and description thereof is omitted.

As shown in FIG. 7, the droplet discharge device according to this embodiment comprises, an intermediate viscosity liquid storage section (third storage section) 214 which stores an intermediate viscosity liquid (third liquid) L3 with a lower viscosity than the high viscosity liquid L1 and a higher viscosity than the low viscosity liquid L2. Moreover, the liquid supply pipe 205 has a third branch path 205*c* connected to the branch point M, and an intermediate viscosity liquid storage section 214 is connected to this third branch path 205*c*. A third valve 206*c* is provided in the third branch path 205*c*.

Furthermore, preferably the low viscosity liquid L2 is a solvent of the intermediate viscosity liquid L3, and the intermediate viscosity liquid L3 is a solvent of the high viscosity liquid L1.

At the time of filling the liquid into the head section 201 in the droplet discharge device according to this embodiment, in a condition where the liquid is not filled to inside of the head section 201, the high viscosity liquid L1 is supplied from the high viscosity liquid storage section 203, and if the high viscosity liquid L1 reaches the branch point M, supply of the high viscosity liquid L1 from the high viscosity liquid storage section 203 is stopped. On the other hand, the intermediate viscosity liquid L3 is supplied from the intermediate viscosity liquid storage section 214, and if the intermediate viscosity liquid L3 reaches the branch point M, supply of the intermediate viscosity liquid L3 from the intermediate viscosity liquid storage section 214 is stopped. Supply of the high viscosity liquid L1 and the intermediate viscosity liquid L3 may be performed simultaneously, or one or the other may be performed first.

Next, the low viscosity liquid L2 is supplied from the low viscosity liquid storage section 204, so that the low viscosity liquid L2 fills the interior of the head section 201 via the liquid supply pipe 205. Then, supply of the low viscosity liquid L2 from the low viscosity liquid storage section 204 is stopped, and the intermediate viscosity liquid L3 is supplied from the intermediate viscosity liquid storage section 214, and while discharging the low viscosity liquid L2 filled to inside the head section 201 and the liquid supply pipe 205, from the plurality of nozzle openings of the head section 201, the intermediate viscosity liquid L3 is introduced to the head section 201, and the low viscosity liquid L2 inside the head section 201 is replaced by the intermediate viscosity liquid L3, and the intermediate viscosity liquid L3 is filled to inside the head section 201.

Next, supply of the intermediate viscosity liquid L3 from the intermediate viscosity liquid storage section 214 is stopped, and the high viscosity liquid L1 is supplied form the high viscosity liquid storage section 203, and while discharging the intermediate viscosity liquid L3 filled to inside of the head section 201 and the liquid supply pipe 205, from the plurality of nozzle openings of the head section 201, the high viscosity liquid L1 is introduced to the head section 201, and the intermediate viscosity liquid L3 inside the head section 201 is replaced by the high viscosity liquid L1, and the high viscosity liquid L1 is filled to inside the head section 201.

In this manner, in this embodiment, the high viscosity liquid L1, the intermediate viscosity liquid L3 and the low viscosity liquid L2 can be selectively supplied to the head section 201, and at the time of initial filling of the liquid into the head section 201, first of all the low viscosity liquid L2 is supplied to the head section 201, after which the supplied low viscosity liquid L2 can be replaced by the intermediate viscosity liquid L3, and then the intermediate viscosity liquid L3 replaced by the high viscosity liquid L1. Therefore even in the case where the viscosity of the high viscosity liquid L1 is the relatively high, the high viscosity liquid L1 can be reliably filled without residual bubbles, into the interior of liquid passages having a complicated construction formed in the head section 201.

FIG. 8 through FIG. 17 show a fourth embodiment of the present invention.

In this embodiment, the droplet discharge device of the present invention is described as being applicable to a color filter manufacturing apparatus (device manufacturing apparatus) for manufacturing color filters or the like, used for example in liquid crystal display devices.

Figure 8:
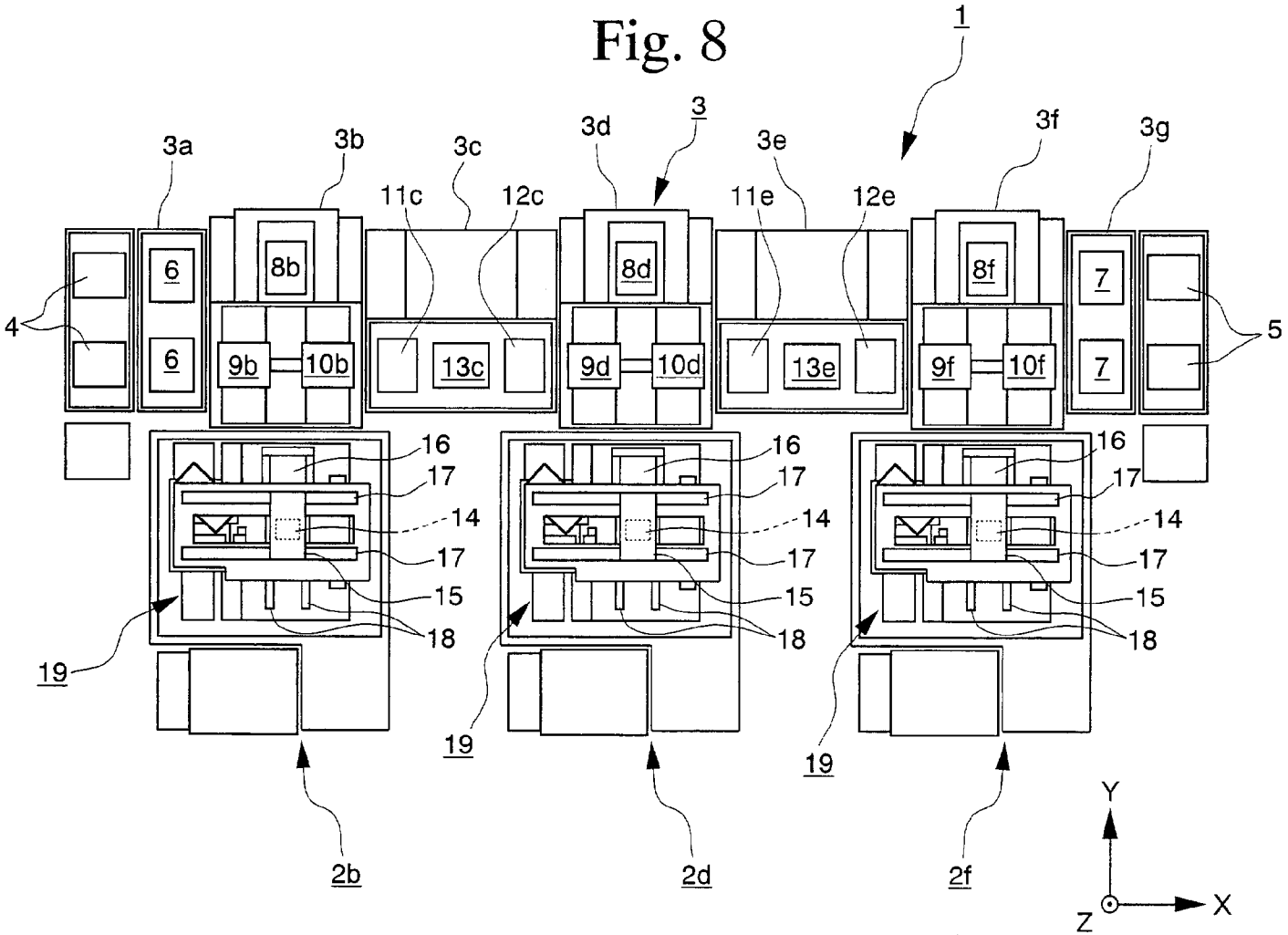
FIG. 8 shows a fourth embodiment of the present invention, being a schematic plan view of a filter manufacturing apparatus.

FIG. 8 is a schematic plan view of the filter manufacturing apparatus (device manufacturing apparatus) 1. The filter manufacturing apparatus 1 is provided with three drawing devices (droplet discharge devices) 2*b*, 2*d* and 2*f* which have substantially the same construction, and a transport system 3 which transports substrates such as glass substrates between the drawing devices 2*b*, 2*d* and 2*f*.

The transport system 3 is for transporting the respective substrates between a magazine loader 4 and the drawing device 2*b*, between the drawing devices 2*b*, 2*d* and 2*f*, and between the drawing device 2*f* and a magazine unloader 5. Substrate transferring and rotating areas 3*a* and 3*g*, drawing device areas 3*b*, 3*d*, and 3*f*, and intermediate transferring areas 3*c* and 3*e* are positioned along the X direction (the left and right direction in FIG. 8). Hereunder the scanning direction in which substrate moves at the time of impacting the liquid is described as the Y direction (the up and down direction in FIG. 8) and the direction orthogonal to the page in FIG. 8 is described as the Z direction.

The magazine loader 4 can store a plurality of substrates (for example 20 along the Z direction), in two rows spaced apart in the Y direction. Similarly, the magazine unloader 5 can store a plurality of substrates (for example 20 along the Z direction), in two rows spaced apart in the Y direction.

In the substrate transferring and rotating area 3*a*, mounting stands 6 are respectively installed in positions facing the magazine loaders 4. The mounting stands 6 are configured to rotate 90° by means of a rotation drive unit (not shown in the figure), to temporally position the mounted substrates. Similarly, in the substrate transferring and rotating area 3*g*, mounting stands 7 are respectively arranged in positions facing the magazine unloaders 5. The mounting stands 7 are configured to rotate 90° by means of a rotation drive unit (not shown in the figure).

In the drawing device area 3*b*, there is installed a heating apparatus (bake oven) 8*b* which heats the substrates, and transfer robots 9*b* and 10*b* of a double-arm construction. The heating apparatus 8*b* is for heating (baking) substrates which have been drawn by the drawing device 2*b* (for example at 120° C.×5 min). The transfer robot 9*b* is for transferring substrates retained by suction attraction, between the magazine loader 4 and the mounting stand 6 and between the mounting stand 6 and the drawing device 2*b*. The transfer robot 10*b* is for transferring substrates retained by suction attraction, between the drawing device 2*b* and the heating apparatus 8*b*, between the heating apparatus 8*b* and a later described cooling section 11*c*, and between the cooling section 11*c* and a later described buffer section 13*c*.

In the intermediate transferring area 3*c*, there is installed the cooling section 11*c* which cools the substrates, the rotating section 12*c* which respectively rotates the mounted substrates through 90° or 180° by means of a rotation drive unit (not shown in the figure), and the buffer section 13*c* which stocks the substrates which cannot be transferred from the cooling section 11*c* to the rotating section 12*c*, due for example to processing time differences between the drawing devices 2*b* and 2*d* (for example, the difference in time required for head cleaning). The buffer section 13*c* has a plurality of slots for substrate stacking in the Z direction, and can be freely moved in Z direction.

In the drawing device area 3*d*, there is installed a heating apparatus 8*d* which heats substrates, and transfer robots 9*d* and 10*d* of a double-arm construction. The heating apparatus 8*d* is for heating substrates which have been drawn by the drawing device 2*d* (for example at 120° C.×5 min). The transfer robot 9*d* is for transferring substrates retained by suction attraction, between the buffer section 13*c* and the rotating section 12*c*, and between the rotating section 12*c* and the drawing device 2*d*. The transfer robot 10*d* is for transferring substrates retained by suction attraction, between the drawing device 2*d* and the heating apparatus 8*d*, between the heating apparatus 8*d* and a later described cooling section 11*e*, and between the cooling section 11*e* and a later described buffer section 13*e*.

In the intermediate transferring area 3*e*, there is installed the cooling section 11*e* which cools the substrates, the rotating section 12*e* which respectively rotates the mounted substrates through 90° or 180° by means of a rotation drive unit (not shown in the figure), and the buffer section 13*e* which stocks the substrates which cannot be transferred from the cooling section 11*e* to the rotating section 12*e*, due for example to processing time differences between the drawing devices 2*d* and 2*f* (for example, the difference in time required for head cleaning). The buffer section 13*e* has a plurality of slots for substrate stacking in the Z direction, and can be freely moved in Z direction.

In the drawing device area 3*f*, there is installed a heating apparatus 8*f* which heats substrates, and transfer robots 9*f* and 10*f* of a double-arm construction. The heating apparatus 8*f* is for heating substrates which have been drawn by the drawing device 2*f* (for example, at 120° C.×5 min). The transfer robot 9*f* is for transferring substrates retained by suction attraction, between the buffer section 13*e* and the rotating section 12*e*, and between the rotating section 12*e* and the drawing device 2*f*. The transfer robot 10*f* is for transferring substrates retained by suction attraction, between the drawing device 2*f* and the heating apparatus 8*f*, between the heating apparatus 8*f* and the mounting stand 7 of the substrate transferring and rotating area, and between the mounting stand 7 and the magazine unloader 5.

The drawing devices 2*b*, 2*d*, 2*f* are for performing drawing processes (film production processes) on transferred substrates, using respective coloring liquids of red, blue and green. These generally each have substantially the same construction, and comprise: a droplet discharge head 14 stored in a thermal clean chamber (not shown in the figure); an X table 15 which supports the droplet discharge head 14 and is moved in the X direction along a pair of X guides 17 by a drive unit such as a linear motor; a Y table 16 arranged below the X table 15 (on the—Z side) which retains a substrate by suction attraction and moves in the Y direction along a pair of Y guides 18; and a liquid system 19.

The X table 15 drives and positions the droplet discharge head 14 in the X direction by means of a drive unit such as a linear motor, and also drives and positions the droplet discharge head 14 in a θZ direction (in a rotation direction about the Z axis), in a θX direction (in a rotation direction about the X axis), and in a θY direction (in a rotation direction about the Y axis), by means of a rotation drive unit such as a direct drive motor. Furthermore, the X table 15 is provided with a motor (not shown in the figure) for driving and positioning the droplet discharge head 14 in the Z direction.

The Y table 16 is driven and positioned in the Y direction by means of a drive unit such as a linear motor, and is also driven and positioned in the θ direction (in a rotation direction about the Z axis) by means of a rotation drive unit such as a direct drive motor. In the vicinity of a moving path of the Y table 16, a substrate alignment camera (not shown in the figure) is installed, and the mounting direction and position of the substrate can be detected by detecting an alignment mark formed on the transported substrate.

Figure 9:
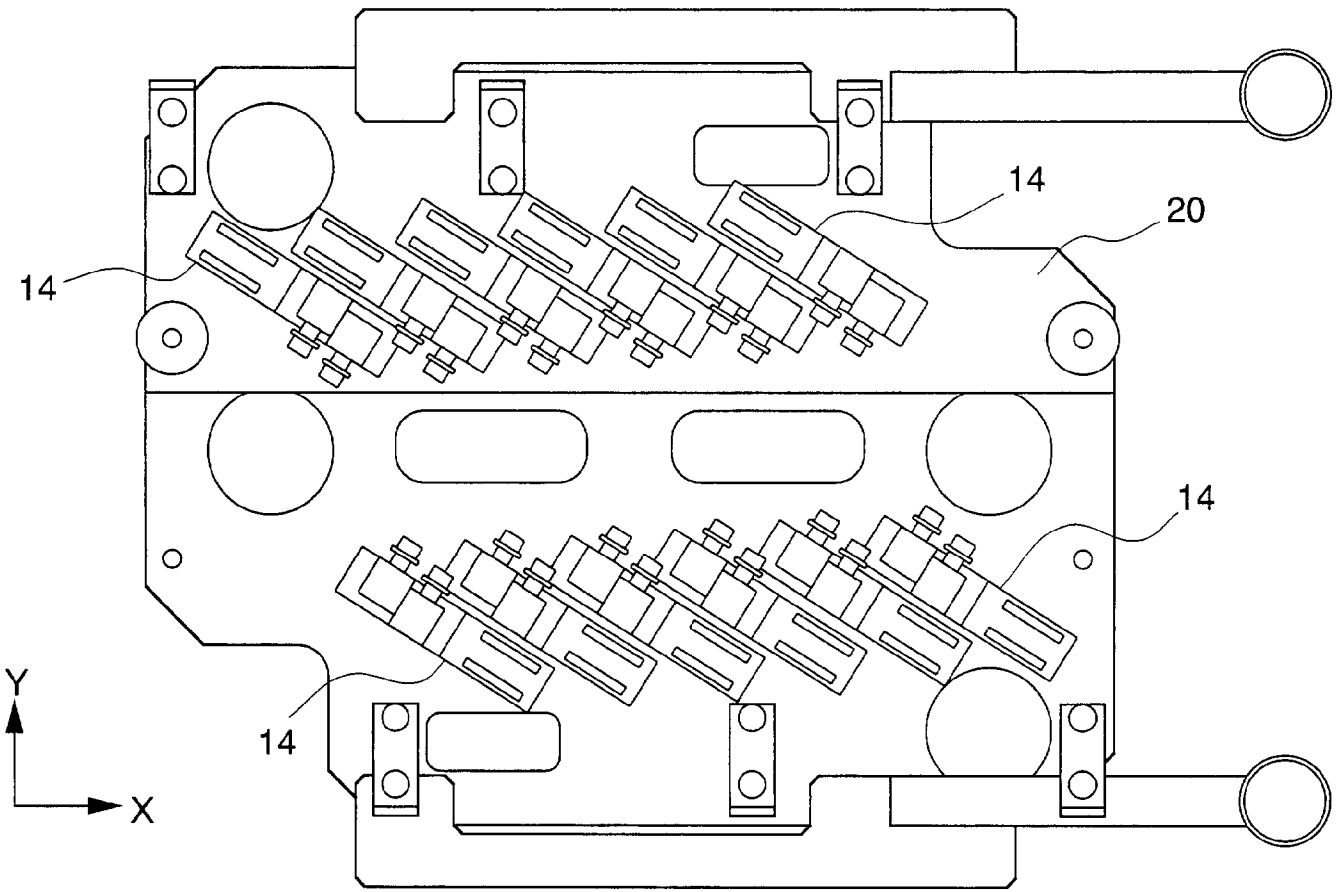
FIG. 9 is a plan view of a support plate for supporting a droplet discharge head.

As shown in FIG. 9, the droplet discharge head 14 has a rectangular shape as seen in plan view, and a plurality of nozzles is provided on the liquid discharge face (on a face facing the substrate) in two rows along the length direction of the head (for example, 180 nozzles in one row, 360 nozzles in total), spaced apart in the width direction of the head. The plurality of droplet discharge heads 14 (in FIG. 9, six in one row, and twelve in total) are positioned and supported on a support plate 20 having a rectangular shape as seen in plan view, with the nozzles directed towards the substrate, and arranged in two rows substantially along the X axis inclined by a predetermined angle with respect to the X axis (or the Y axis), and with predetermined spacing therebetween in the Y direction. The droplet discharge heads 14 are supported on the X table 15 via this support plate 20. The angle of inclination of the droplet discharge head 14 with respect to the X axis (or Y axis) is set based on the array pitch of the filter elements formed on the substrate.

Figure 10:
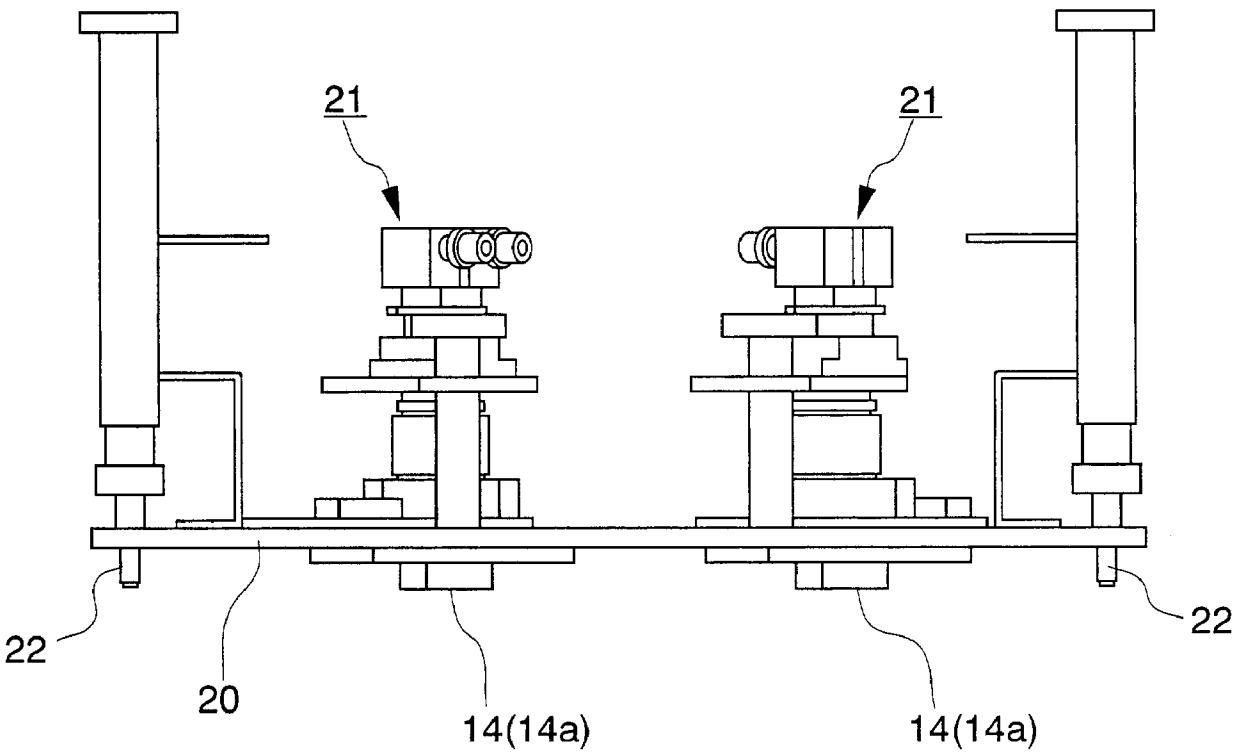
FIG. 10 is a right side view of FIG. 9.

FIG. 10 is a right side view in FIG. 9. As shown in this figure, each of the droplet discharge heads 14 is respectively provided with an introduction unit 21 for introducing the liquid supplied from the liquid system 19 (these introduction units 21 are omitted in FIG. 9). The respective introduction units 21 have a construction such that the liquid is supplied in two systems for each row of the nozzles. On the side of the support plate 20 where the droplet discharge heads 14 are fitted, are protrudingly provided a plurality of shafts 22 with holes for position detection (not shown in the figure) formed on their tips. The image of these holes is taken by a head alignment camera detection (not shown in the figure) to detect the position thereof, and the position in the θ direction of the support plate 20 with respect to the X table 15 is corrected by a rotation drive unit such as a motor. As a result, the position of the droplet discharge head 14 (and the position of the nozzles) can be aligned (positioned).

Figure 11:
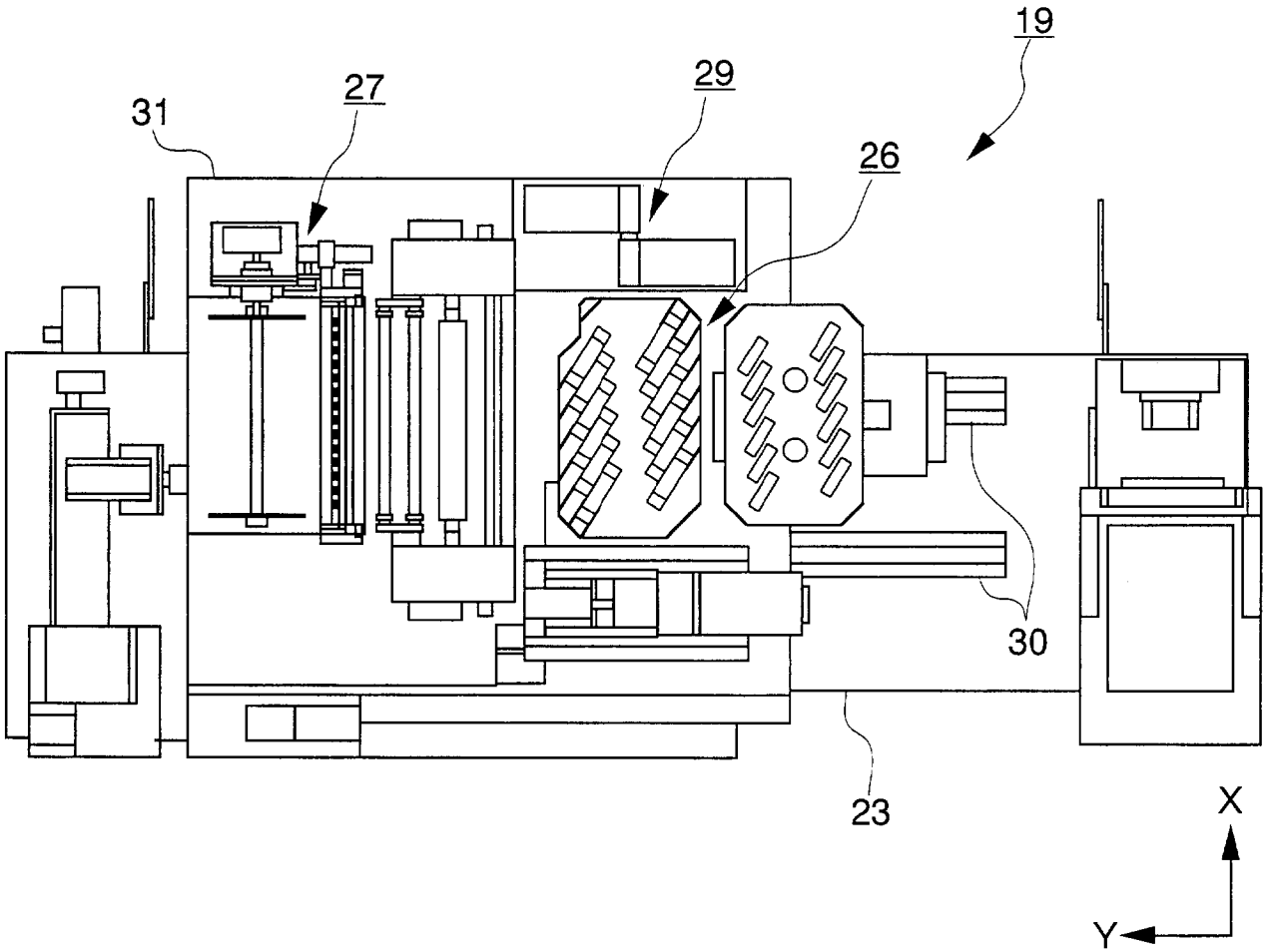
FIG. 11 is a schematic plan view of a liquid system constituting a film production apparatus.
Figure 12:
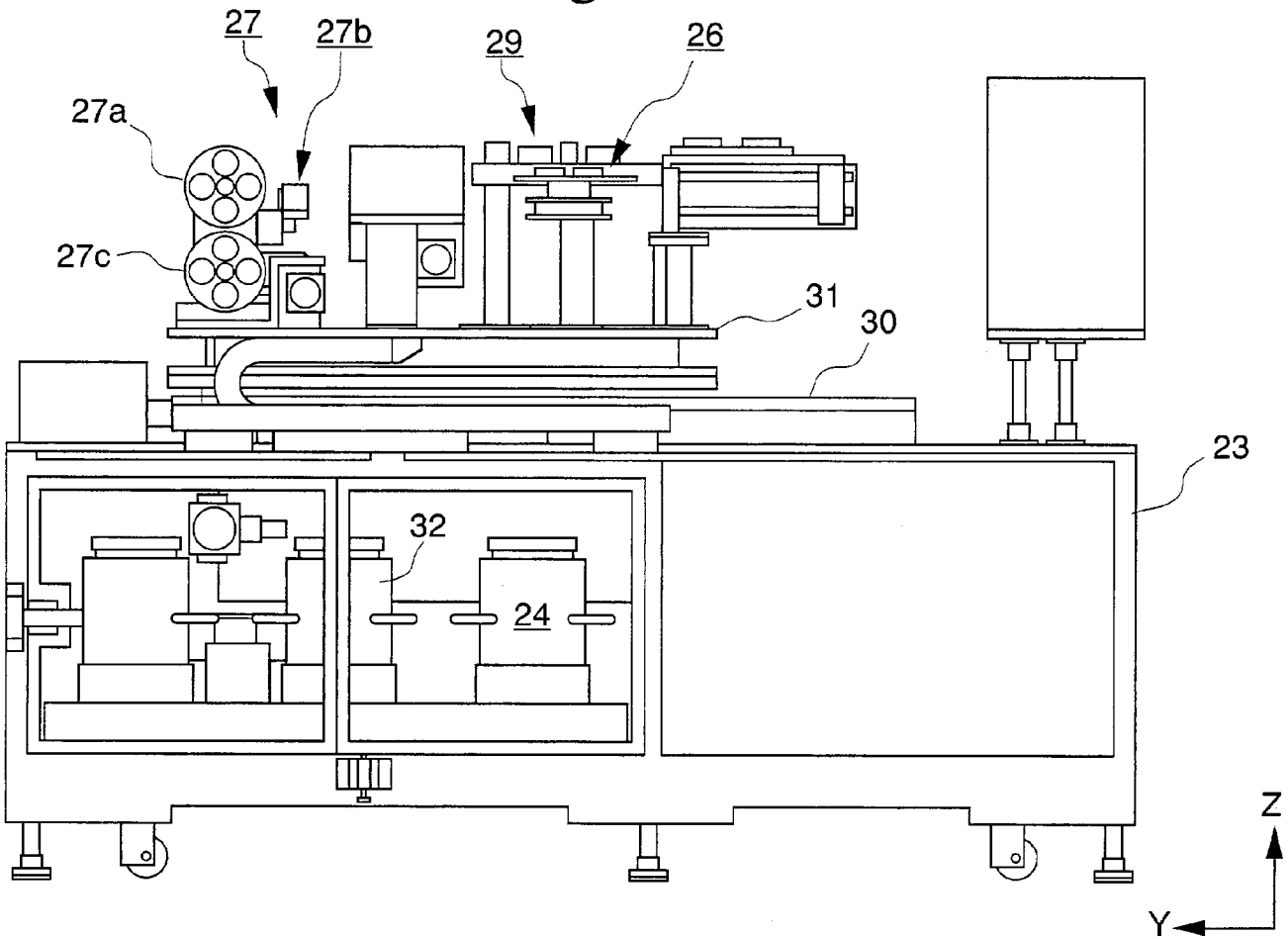
FIG. 12 is a front view of FIG. 11.

As shown in FIG. 11 and FIG. 12, the liquid system 19 comprises a liquid unit (described later) which supplies liquid stored in a liquid tank 24 and filling liquid stored in a filling liquid tank 25 (described later, see FIG. 15) to the droplet discharge heads 14, and recovers and discharges the liquid, a cap unit 26, a wiping unit 27 and a discharge confirmation unit 29. Of these, the cap unit 26, the wiping unit 27 and the discharge confirmation unit 29 are arranged below the droplet discharge heads 14, and installed on a moving board 31 which moves in the Y direction along the pair of Y guides 30 on the base 23, and are capable of moving integrally with the moving board 31 in the Y direction.

The wiping unit 27 is for wiping the liquid discharge face (that is, substantially the nozzle face) of the droplet discharge head 14 by a cloth material such as a belt-like unwoven cloth, and comprises an unwinding reel 27*a* for unwinding the cloth material, a cleaning solution discharge section 27*b* which discharges cleaning solution to be supplied from a cleaning solution tank 32 installed on the base 23 to the cloth material, and a winding reel 27*c* for winding the cloth material which has wiped the droplet discharge heads 14. By synchronously driving the unwinding reel 27*a*, the cleaning solution discharge section 27*b*, the winding reel 27*c* and the moving board 31, it is possible to wipe the liquid discharge face with the cloth material containing the cleaning solution, for example, after the drawing process on the substrate.

The discharge confirmation unit 29 is provided in two places for each row where the droplet discharge heads 14 are arranged, below the moving path of the droplet discharge heads 14 in the X direction. Each unit 29 is provided with a discharge detection unit (detection unit, not shown) for detecting the discharge condition of the liquid from the nozzle for each droplet discharge head 14 and for each nozzle, by the shading or transmission of a laser beam, and the detection result is output to a control unit 52 (described later).

Figure 13:
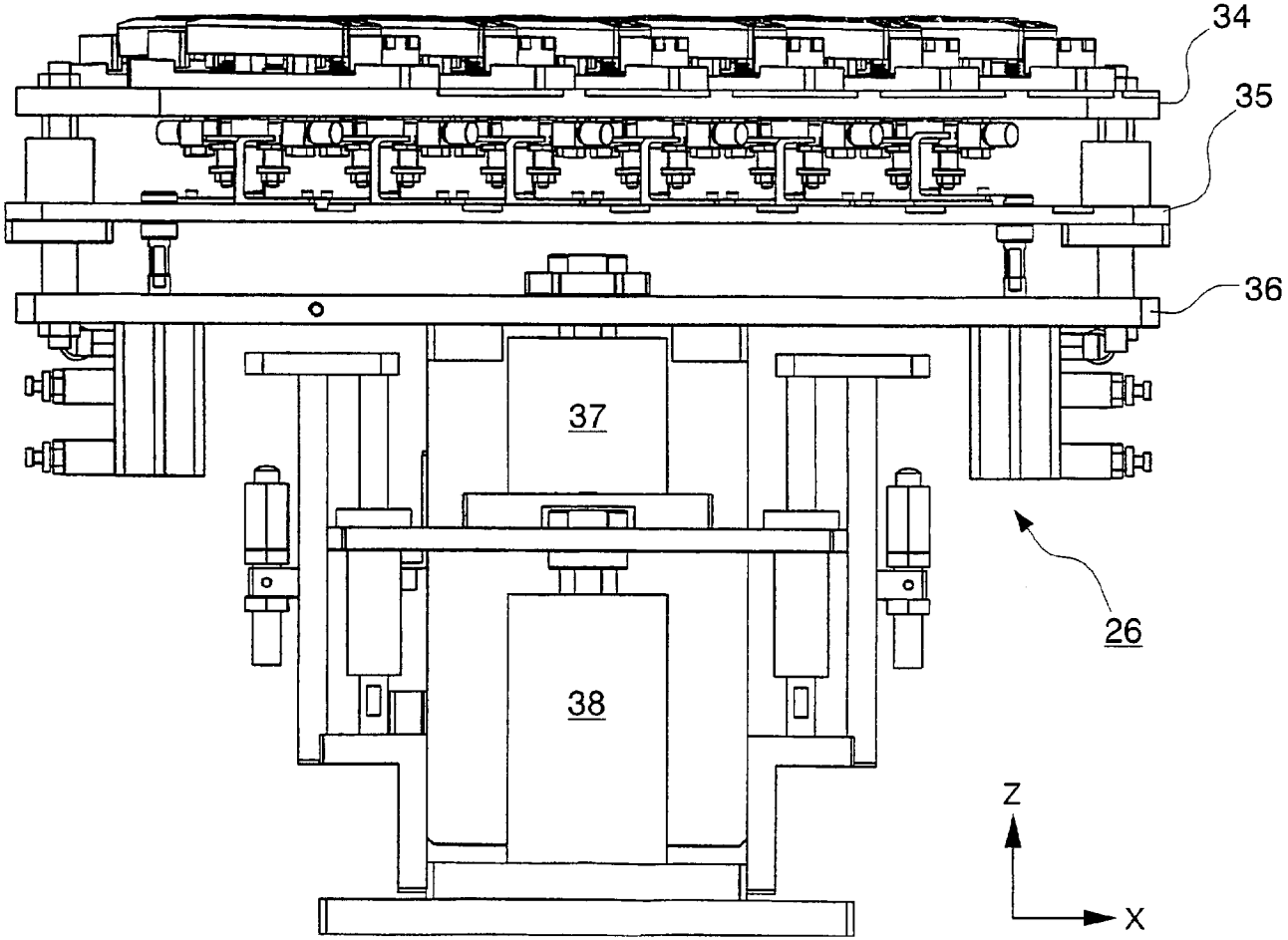
FIG. 13 is a schematic front view of a cap unit constituting the liquid system.

FIG. 13 is a schematic block diagram (front view) of the cap unit 26. The cap unit 26 schematically comprises; a plurality of caps 33 each having a suction pad, a support plate 34 for supporting the caps 33, and shifting devices 37 and 38 such as air cylinders, which drive the support plate 34 in the Z direction via support plates 35 and 36 connected to the support plate 34.

Figure 14:
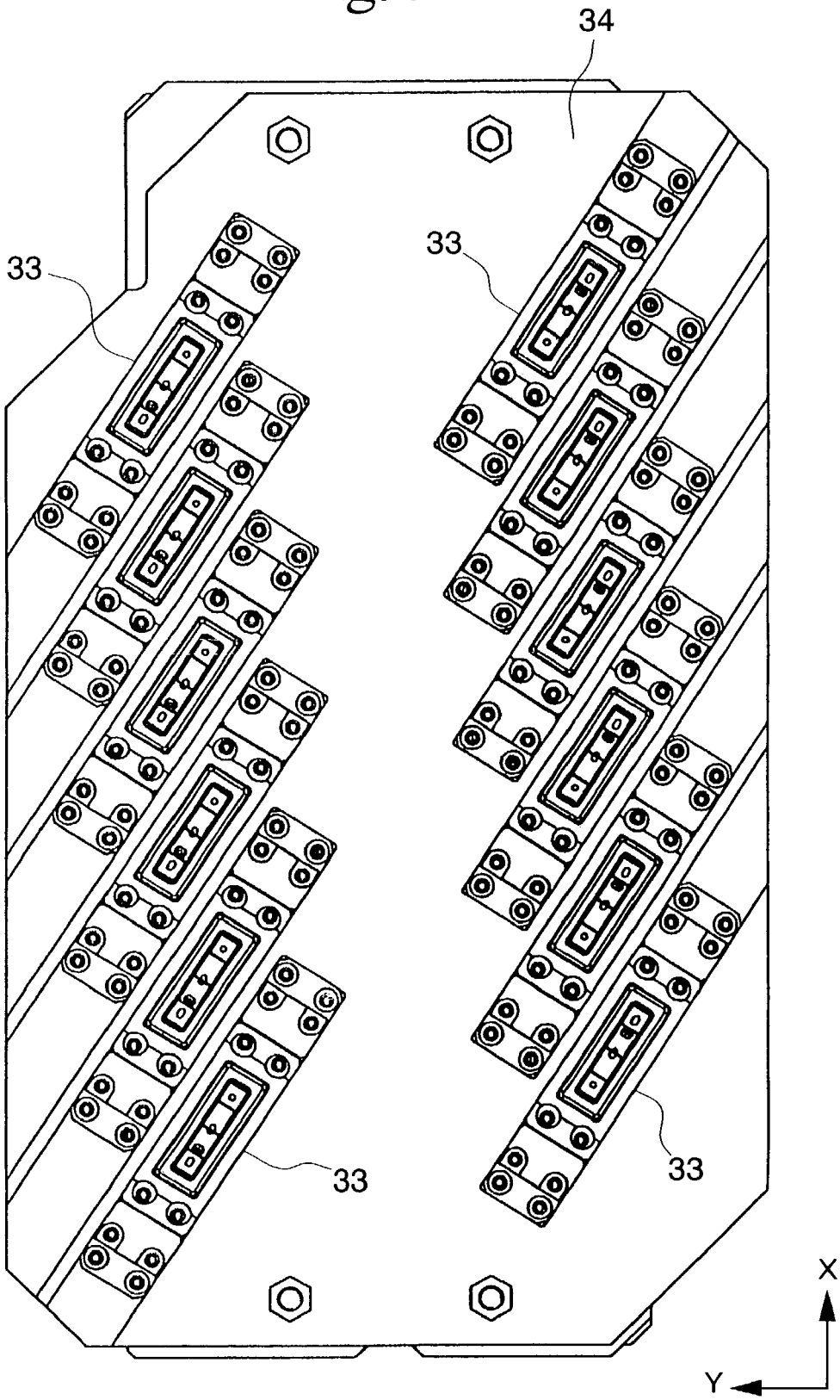
FIG. 14 is a plan view of a support plate for supporting the cap.

The caps (cap members) 33 are arranged and fixed at positions and with inclinations corresponding to the droplet discharge heads 14, on the upper face side (+Z side) of the support plate 34, on the droplet discharge face 14*a* (see FIG. 10) of the droplet discharge heads 14. More specifically, as shown in FIG. 14 in two rows substantially along the X direction inclined by a predetermined angle with respect to the X axis (or Y axis), with a predetermined spacing in the Y direction. At least the portions of the caps 33 which contact with the high viscosity liquid L1 and the low viscosity liquid L2 are liquid resistant. Therefore, the caps are not corroded by the high viscosity liquid L1 and the low viscosity liquid L2. These caps 33 and support plate 34 are arranged below the moving path of the droplet discharge heads 14 in the X direction.

Figure 15:
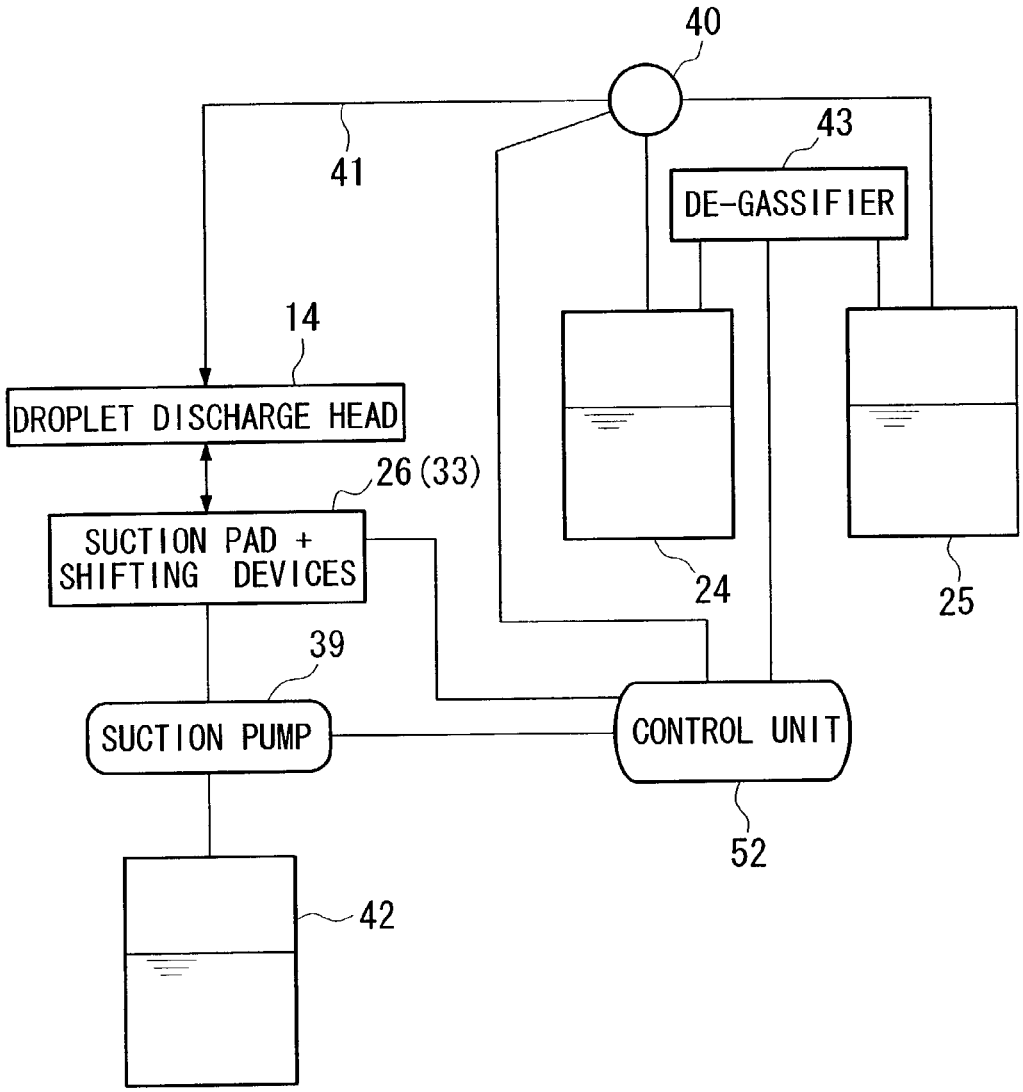
FIG. 15 is a schematic block diagram of a liquid unit.

The shifting devices 37 and 38 are for shifting the support plate 34 between an abutting position where the caps 33 abut against the liquid discharge faces 14*a* of the droplet discharge heads 14 to suck the liquid, and a retracted position where the caps 33 are separated from the droplet discharge heads 14, with the movement thereof in the Z direction restricted by a stopper (not shown in the figure), and the drive thereof controlled by the control unit 52 (see FIG. 15).

As shown in FIG. 15, the liquid unit comprises; a switching unit 40 which selectively switches the liquid to be filled into the droplet discharge head via a liquid sending tube 41 between a drawing liquid (hereinafter simply referred to as liquid) serving as a first liquid stored in the liquid tank 24, and a filling liquid serving as a second liquid stored in the filling liquid tank 25, and a suction pump (suction unit) 39 connected to the caps 33 for sucking the liquid or the filling liquid via the caps 33 and discharging this to a waste liquid tank 42.

As the filling liquid, a solvent component contained in the liquid and having a lower viscosity than that of the liquid is used herein (for example, liquid: 20 mPa·s, filling liquid: 5 to 6 mPa·s). For the switching unit 40, for example, a switching valve is used, and the switching operation is controlled by the control unit 52.

The liquid tank 24 and the filling liquid tank 25 are provided with a de-gassifier (liquid de-gassifier, filling liquid de-gassifier) 43, such as a suction pump, which de-gasses both of the tanks 24 and 25 (that is, the liquid and the filling liquid) collectively. Drive of the de-gassifier is also controlled by the control unit 52. The control unit 52 has a configuration such that it comprehensively controls the shifting devices 37 and 38, the suction pump 39, the switching unit 40 and the de-gassifier 43.

The transportation process for the substrates in the transporting system 3 of the filter production apparatus 1 having the above described configuration, will be described first.

The substrate to be subjected to the drawing process by the coloring liquid is taken out from the magazine loader 4 by the transfer robot 9*b* and mounted on the mounting stand 6, rotated in a direction corresponding to the drawing process, and at the same time, temporarily positioned (preliminary positioning). The substrate on the mounting stand 6 is transferred to the Y table 16 in the drawing device 2*b* again by the transfer robot 9*b*, and is subjected to the drawing process, using for example red liquid.

The substrate having gone through the drawing process in the drawing device 2*b* is transferred from the Y table 16 to the heating unit 8*b* by the transfer robot 10*b* and heated and dried, and is then transferred to the cooling section 11*e* in the intermediate transferring area 3*c*. If another substrate that has been processed before, exists where the substrate is to be transferred, this substrate is transferred in advance by an other transfer robot. Specifically, if an other substrate is retained on the Y table 16, when the transfer robot 9*b* transfers the substrate to the Y table 16, this substrate is transferred in advance to the heating unit 8*b* by the transfer robot 10*b*. In this manner, by adopting a double-arm construction, wasteful waiting time relating to the substrate transfer can be eliminated, and hence production efficiency is improved.

The substrate having cooled in the cooling section 11*c* to an appropriate temperature for the drawing process in the drawing device 2*d*, is transferred to the buffer section 13*c* and stocked therein, so as to accommodate any difference in the process time between the drawing devices 2*b* and 2*d*. In the case where a difference in the process time does not occur, it is not always necessary to stock the substrate in the buffer section 13.

When preparation for processing in the drawing device 2*d* is complete, the transfer robot 9*d* in the drawing device area 3*d* transfers the substrate from the buffer section 13*c* to the rotation section 12*c*. The substrate rotated and positioned by the rotation section 12*c* in a direction corresponding to the drawing process in the drawing device 2*d*, is transferred to the Y table 16 in the drawing device 2*d* by the transfer robot 9*d*, and is subjected to the drawing process using for example the blue liquid.

The subsequent operation is similar to the operation described above, and hence will only be described in brief. The substrate having gone through the drawing process in the drawing device 2*d* is transferred from the Y table 16 to the heating unit 8*d* by the transfer robot 10*d* and heated and dried, and is then transferred to the cooling section 11*e* in the intermediate transferring area 3*e*. The cooled substrate is transferred to the buffer section 13*e* by the transfer robot 10*d*, and is then transferred to the rotation section 12*e* by the transfer robot 9*f*, and rotated and positioned according to the process in the drawing device 2*f*. Then the substrate is transferred to the Y table 16 in the drawing device 2*f* by the transfer robot 9*f*, and is subjected to the drawing process using for example the green liquid.

The substrate having gone through the drawing process in the drawing device 2*f* is transferred to the heating unit 8*f* by the transfer robot 10*f* and heated, and is then transferred to the mounting stand 7 in the substrate transferring and rotating area 3*g*. The substrate is then rotated in a direction for at the time of storing the substrate in the magazine unloader 5, and stored in the magazine unloader 5 again by the transfer robot 10*f*.

Next is a description of the substrate drawing process steps in the drawing devices 2*b*, 2*d* and 2*f*.

When the substrate is transferred to the Y table 16, the mounting direction and position of the substrate is detected by imaging the alignment mark of the substrate by the substrate alignment camera. By driving the drive unit and the rotation drive unit based on the detected position, the substrate is positioned (aligned) at a predetermined position. On the other hand, with respect to the droplet discharge heads 14, by imaging the holes in the shafts 22 by the head alignment camera, the position of the support plate 20, that is, the position of the droplet discharge heads 14 (and the position of the nozzle) is detected, and the droplet discharge heads 14 are positioned at a predetermined position and attitude, by driving the drive unit such as a linear motor or a direct drive motor.

Here, at the initial stage of the drawing process, the liquid is not introduced to the droplet discharge heads 14. Therefore, before drawing, the droplet discharge heads 14 are sucked by the suction pump 39 to thereby introduce the liquid. Specifically, at first the X table 15 moves in the X direction to position the droplet discharge heads 14 at positions facing the caps 33. Then the support plate 34 is shifted from the retracted position to the abutting position in the +Z direction by driving the shifting devices 37 and 38.

As a result, all caps 33 respectively abut against the corresponding droplet discharge faces 14*a* of the droplet discharge heads 14.

Then, when the caps 33 are positioned at the abutting positions, the control unit 52 actuates the suction unit 39. At this time, the control unit 52 operates the switching unit 40 in advance to allow the filling liquid tank 25 to communicate with the liquid sending tube 41. As a result, the de-gassed filling liquid is sucked, and is filled into the droplet discharge heads 14 from the filling liquid tank 25 through the liquid sending tube 41. The filling liquid filled into the droplet discharge heads 14 is sucked to the caps 33, and is then discharged from the suction pad through the suction pump 39 to the waste liquid tank 42. Moreover, bubbles in the droplet discharge heads 14 are discharged together with the filling liquid from the droplet discharge heads 14 without any problem, because the viscosity of the filling liquid is low.

After filling and discharge of the filling liquid have been carried out for a predetermined period of time, the control unit 52 operates the switching unit 40, to allow the liquid tank 24 to communicate with the liquid sending tube 41. As a result, the de-gassed liquid having a relatively high viscosity is introduced to the droplet discharge heads 14 from the liquid tank 24 through the liquid sending tube 41, and the filling liquid inside the droplet discharge heads 14 is replaced by the liquid. Since bubbles in the droplet discharge heads 14 are removed by filling the filling liquid beforehand, then even when a high viscosity liquid is to be filled, bubbles do not remain in the droplet discharge head 14.

When the liquid and the filling liquid are to be filled into the droplet discharge heads 14, the control unit 52 sets suction conditions for the suction pump 39, in accordance with the viscosity of the liquid and the filling liquid supplied to the droplet discharge heads 14. Specifically, the control unit 52 sets a negative pressure (suction force) and suction time to optimum values, as the suction conditions, according to the viscosity of the liquid and the filling liquid supplied to the droplet discharge heads 14. The optimum values are preferably measured by experiments or simulation and stored in advance. When the suction force is set according to the viscosity as the suction condition, it is desirable to install a measuring instrument for measuring the suction force by the suction pump 39 in a suction path or the like, and feed-back control the suction pump 39 based on the measurement result of the measuring instrument, since this enables the negative suction force to be set highly accurately.

When the liquid is filled into the droplet discharge heads 14, then even if the filling liquid filled beforehand remains therein, since the filling liquid comprises a solvent component contained in the liquid, there is practically no problem if the filling liquid is mixed with the liquid, and there is no adverse affect on the liquid properties (drawing properties). Even if bubbles are not present immediately after filling the filling liquid or liquid into the droplet discharge heads 14, bubbles may occur in the filling liquid or liquid due to elapse of time. However, since the preliminarily de-gassed filling liquid and liquid are filled into the droplet discharge heads 14, bubbles do not occur, and on the contrary, bubbles remaining in the droplet discharge heads 14 can be absorbed by these liquids.

When the liquid is introduced to and filled into the droplet discharge head 14 (nozzle), the droplet discharge head 14 is shifted to above the discharge confirmation unit 29 via the X table. Then the liquid is preliminarily discharged to the discharge confirmation unit 29 from the droplet discharge head 14. More specifically, the support plate 20 is moved back and forth above the discharge confirmation unit 29, and the liquid is discharged from the droplet discharge heads 14 for each row, respectively, on the forward and return trips. At the time of discharging the liquid, the discharge detection apparatus irradiates detection light such as laser beams, to detect the discharge condition of the liquid for each droplet discharge head 14 and for each nozzle, performing a so-called dot omission detection. Here, when dot omission is detected, the droplet discharge head 14 is sucked by the cap unit 26 in the same procedure as described above.

When preparation of the liquid for the drawing process is complete, the drawing process is executed. Actually, the weight of the liquid discharged from the droplet discharge head 14 is measured, but here explanation of this is omitted. Hereunder is a description of an example in which a color filter is manufactured by the drawing process, with reference to FIG. 16A to FIG. 16F and FIG. 17.

The substrate 100 in FIG. 16A to FIG. 16F is a transparent substrate, and one having an appropriate mechanical strength and high optical transparency is used. For the substrate 100, for example, a transparent glass substrate, an acrylic glass, a plastic substrate, a plastic film and surface treated articles thereof can be used.

Figure 17:
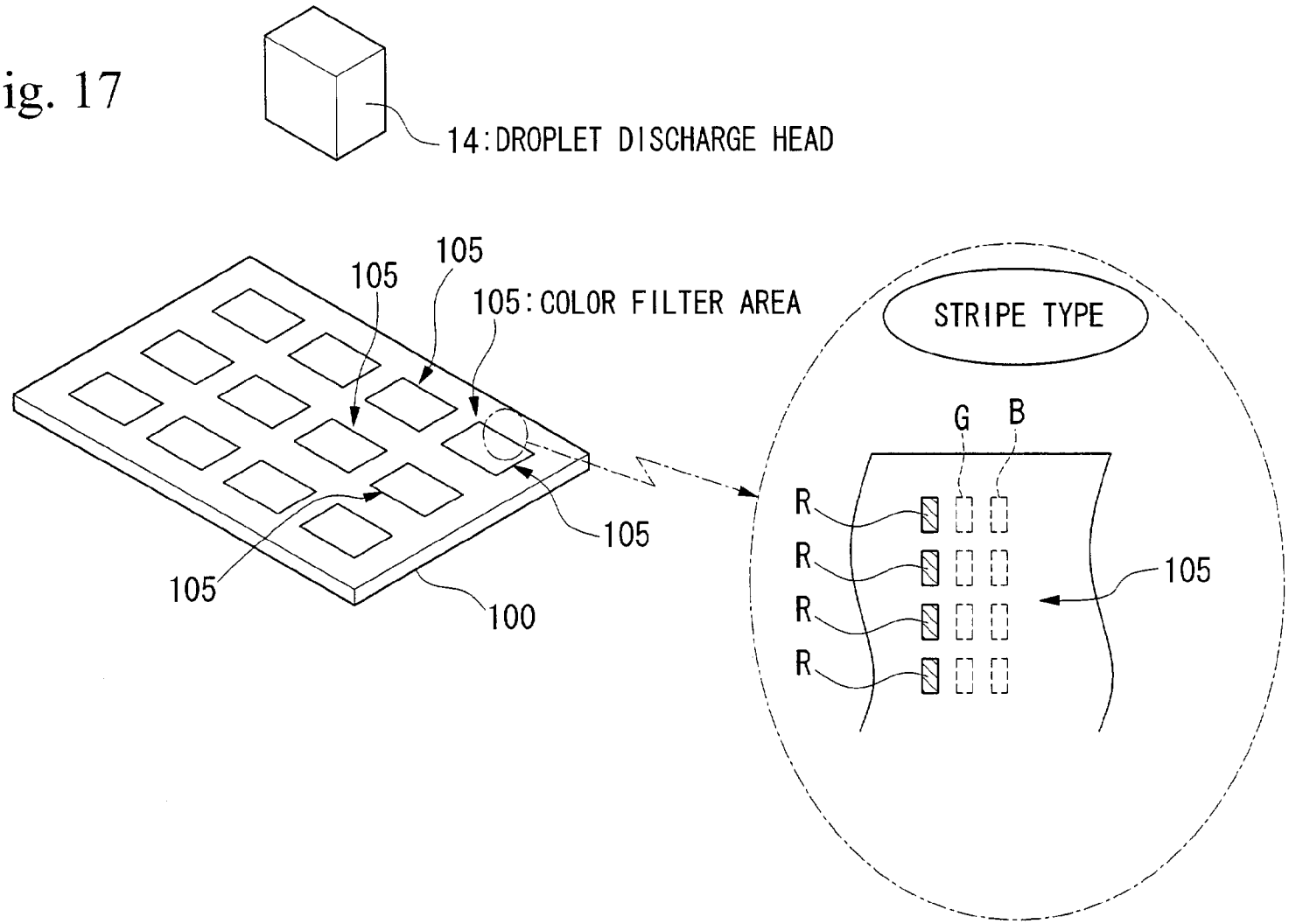
FIG. 17 shows a substrate and a part of a color filter region on the substrate.

For example, as shown in FIG. 17, a plurality of color filter areas 105 is formed in a matrix on the rectangular substrate 100, from the viewpoint of increasing the productivity. These color filter areas 105 can be used as color filters suitable for liquid crystal display devices, by cutting the glass 100 in a later stage.

As shown in FIG. 17, for example, R liquid, G liquid and B liquid are formed and arranged in a predetermined pattern on the color filter area 105. This formation pattern includes, as shown in the figure, a conventionally known stripe type, as well as a mosaic type, a delta type and a square type.

FIG. 16A to FIG. 16F show one example of steps for forming the color filter area 105 on the substrate 100.

In FIG. 16A, a black matrix 110 is formed on one face of the transparent substrate 100. On the substrate 100, which becomes a base for the color filter, a resin having no optical transparency (preferably black) is applied in a predetermined thickness (for example, about 2 $\mu$m) by a method of spin coating or the like, to provide the black matrix 110 in a matrix form by a method such as a photolithography method. The smallest display element surrounded by a lattice of the black matrix 110 is referred to as a filter element, which is a window having, for example, a width of 30 $\mu$m in the direction of the X axis and a length of about 100 $\mu$m in the direction of the Y axis.

After the black matrix 110 is formed, the resin on the substrate 100 is baked, for example by applying heat with a heater.

As shown in FIG. 16B, the droplets 99 impact on the filter element 112. The quantity of the droplets 99 is a sufficient quantity, taking into consideration a volume reduction of the liquid in the heating step.

In the heating step shown in FIG. 16C, when the droplets 99 are filled into all the filter elements on the color filter, the heating process is carried out using a heater. The substrate 100 is heated to a predetermined temperature (for example, about 70° C.). When the solvent in the liquid evaporates, the liquid volume decreases. If the volume decrease is too quick, the liquid discharge step and the heating step are repeated until a sufficient thickness of the liquid film as the color filter can be obtained. By this process, the solvent in the liquid evaporates, and only solids in the liquid finally remain and are formed into a film.

In a protective film forming step in FIG. 16D, heating is carried out at a predetermined temperature for a predetermined period of time, in order to completely dry the droplets 99. When drying has finished, a protective film 120 is formed in order to protect the substrate 100 of the color filter having the liquid film formed thereon and to flatten the filter surface. For example, a spin coating method, a roll coating method or a ripping method can be employed for forming the protective film 120.

In a transparent electrode forming step in FIG. 16E, a transparent electrode 130 is formed over the whole surface of the protective film 120, using a method such as sputtering or vacuum adsorption.

In a patterning step in FIG. 16F, the transparent electrode 130 is further patterned on pixel electrodes corresponding to the openings of the filter element 112.

Figure 18:
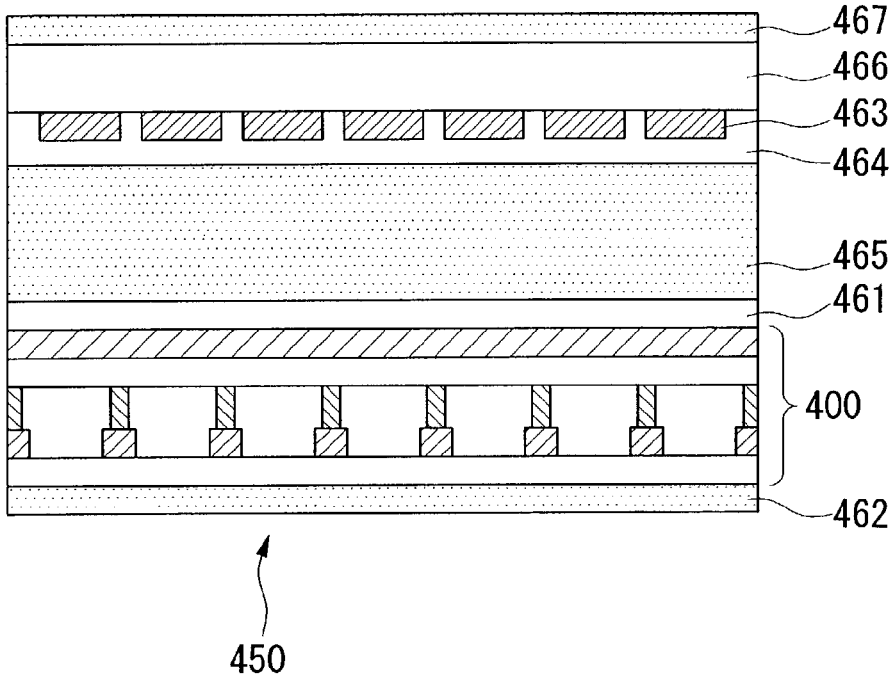
FIG. 18 is a cross-section of a liquid crystal panel which incorporates a color filter manufactured using the present invention.

When a TFT (Thin Film Transistor) or the like is used for driving the liquid crystal display panel, this patterning is not required. FIG. 18 shows an example of a liquid crystal panel having for example a color filter manufactured according to the present invention, and an opposed substrate. In this figure, a liquid crystal panel 450 is constructed by combining a color filter 400 and an opposed substrate 466 between upper and lower deflector plates 462 and 467, and enclosing a liquid crystal composition 465 therebetween. Between the color filter 400 and the opposed substrate 466 are formed oriented films 461 and 464, and TFT (Thin Film Transistor) elements (not shown in the figure) and pixel electrodes 463 are formed in a matrix on the inner face of the opposed substrate 466 on one side. In this liquid crystal panel, a color filter manufactured by the above described manufacturing method is used as the color filter 400.

During the drawing process it is desirable to wipe the liquid discharge face 14*a* of the droplet discharge head 14 using the wiping unit 27, regularly or at any time. This wiping can be executed by allowing a wet cloth, unwound from the unwinding reel 27*a* and onto which the cleaning solution has been discharged, to slidingly contact with the liquid discharge face 14*a*, with movement of the moving board 31.

When the drawing process has finished, the control unit 52 again allows the filling liquid tank 25 to communicate with the liquid sending tube 41, by operating the switching unit 40, and allows the caps 33 to each abut against the liquid discharge face 14*a* of the droplet discharge head 14, to suck the droplet discharge head 14 by the suction pump 39. As a result, the liquid inside the droplet discharge head 14 is again replaced by the filling liquid. In this manner, if the droplet discharge head 14 is held in the state of being filled by the filling liquid, then even with a rapid drying liquid, this can be used without taking into consideration that this may solidified inside the droplet discharge head 14.

As described above, in this embodiment, after bubbles are discharged through the step of filling the filling liquid into the droplet discharge head 14, the filling liquid is replaced by the liquid. Hence, even when a high viscosity liquid is used, the liquid can be discharged with stable discharge characteristics maintained, and without the occurrence of poor discharge attributable to the presence of bubbles. As a result, it becomes possible to widely expand the use of the droplet discharge device even for industrial use where liquids having various types of viscosity are used.

In this embodiment, since the solvent component contained in the liquid is used as the filling liquid, then even if the filling liquid has not been sufficiently replaced by the liquid, adverse effects on the drawing characteristics of the liquid can be substantially prevented. In addition, even when solidified liquid adheres in the vicinity of the nozzle of the droplet discharge head 14, this solid component can be dissolved by the filling liquid, being a solvent component. Therefore, solids which adversely affect the discharge characteristics of the liquid can be removed, to thereby obtain stable discharge characteristics of the liquid. In particular, in this embodiment, the liquid or the filling liquid is filled by sucking the droplet discharge head 14, and the distance up to the filling point is short, compared to the case where the liquid tank 24 or the filling liquid tank 25 side is pressurized. Hence, effective filling can be realized with pressure loss being reduced, and solids and dirt adhered to the droplet discharge head 14 can be easily removed. Moreover, since the filling liquid constitutes a part of the liquid, when the filling liquid is mixed with the liquid, it is possible to prevent precipitation of solids from the liquid due to so called solvent shock.

Further, in this embodiment, since the filling liquid and the liquid are de-gassed beforehand, prior to being filled into the droplet discharge head 14, then even if bubbles are not present immediately after filling the liquid into the droplet discharge head 14, this can prevent the generation of bubbles from the filling liquid and the liquid due to elapse of time. Furthermore, even if by chance, some bubbles remain inside the droplet discharge head 14, these filling liquid and liquid can absorb these bubbles, and a drop in the discharge characteristics due to bubbles can be avoided.

In this embodiment, since the filled liquid is again replaced by the filling liquid after the drawing process, and the droplet discharge head 14 is kept in this condition, then even rapid drying liquid can be used in the droplet discharge head 14 without taking into consideration that the filling liquid may be solidified thereinside.

With respect to a device such as a liquid crystal display device having a color filter manufactured by the filter production apparatus 1, by applying the drawing process with predetermined discharge characteristics for the liquid, predetermined device properties can be ensured.

In the above embodiments, the de-gassifier 43 de-gasses both the liquid and the filling liquid. However, the present invention is not limited thereto, and for example, de-gassifiers may be provided separately. Moreover, in the above embodiments, the solvent component contained in the liquid is used as the filling liquid, but the present invention is not limited thereto, and for example, a heating unit may be added to the filling liquid tank, and heated liquid may be used as the filling liquid. In this case, since bubbles are discharged by filling the reduced viscosity liquid into the droplet discharge head 14, if the heated liquid is replaced by the drawing liquid of a temperature suitable for the drawing process, a similar effect to that when the solvent component is used can be obtained.

The manufacturing method of the color filter is not limited to the one shown in FIG. 16A to FIG. 16F, and various methods can be employed. A manufacturing method in another aspect is shown in FIGS. 19A to 19I. For example, the surface of a transparent substrate 100 comprising non-alkali glass is cleaned with a cleaning solution in which 1% by weight of hydrogen peroxide solution is added to hot concentrated sulfuric acid, and after being rinsed by pure water, the surface of the transparent substrate 100 is dried by air, to obtain a clean surface. On this surface is formed a chromium film in a predetermined film thickness by a sputtering method, to obtain a metal layer 101 (see FIG. 19A). On the surface of the metal layer 101, a photoresist is spin-coated. The substrate 100 is dried on a hot plate at 80° C. for 5 minutes, to form a photoresist layer 102 (see FIG.

19B). A mask film, on which a predetermined matrix pattern is drawn, is stuck onto the surface of the substrate, and exposed with ultraviolet rays. Then this is immersed in an alkali developer containing potassium hydroxide to remove the photoresist in the unexposed portion, to thereby pattern a resist layer 102 (see FIG. 19C). Subsequently, the exposed metal layer 101 is removed by an etchant composed mainly of hydrochloric acid (see FIG. 19D), and the resist on the chromium is removed. In this manner, a shading layer (black matrix) 110 having a predetermined matrix pattern is obtained (see FIG. 19E).

Figure 19A:
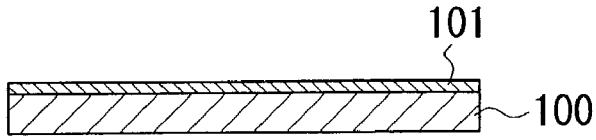
FIGS. 19A to 19I are diagram showing examples of manufacturing a color filter.
Figure 19B:
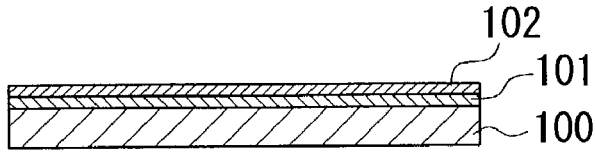
Figure 19C:
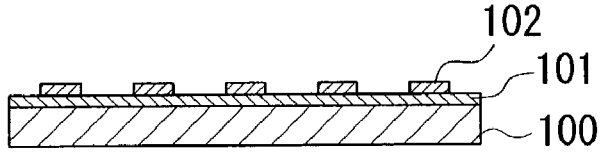
Figure 19D:
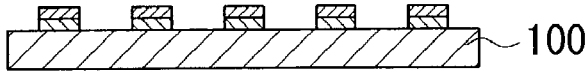
Figure 19E:
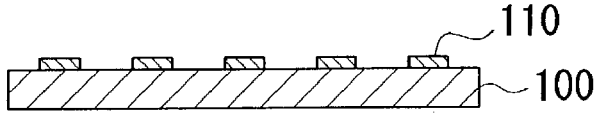
Figure 19F:
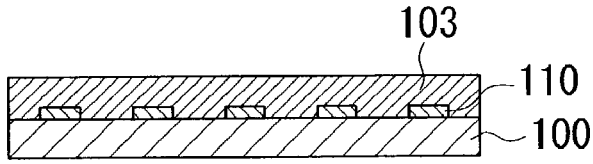
Figure 19G:
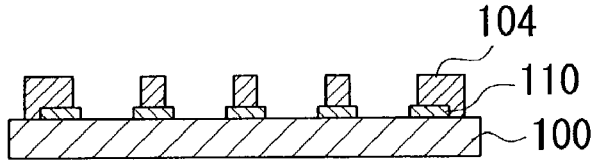
Figure 19H:
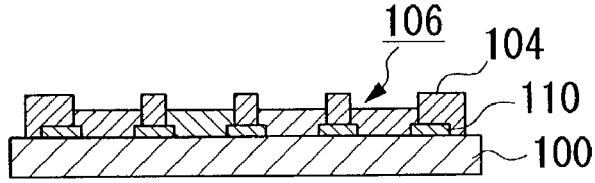
Figure 19I:
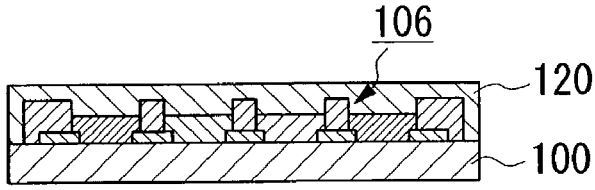

A negative type transparent acrylic photosensitive resin composition 103 is then applied over the whole surface of the substrate 100 by the spin coating method (see FIG. 19F). After pre-baking, ultraviolet exposure is carried out using a mask film having a predetermined matrix pattern drawn thereon. The resin in the unexposed portions is developed by a developer, rinsed with pure water, and spin-dried. After baking is carried out as final drying, the resin portion is sufficiently hardened, to form banks 104 (see FIG. 19G). As shown in FIG. 19G, on the outermost shading layer 110, the bank 104 is formed so as to cover the outermost side. Thereafter, materials which become filters of the respective colors, R, G and B are discharged into the banks 104, using the above described droplet discharge device. The substrate 100 is then heated and subjected to a hardening process for the filter material, to thereby obtain a color film layer (see FIG. 19H). A protection layer 120 (overcoat layer) is formed by applying a transparent acrylic resin paint on the color filter substrate manufactured in this manner, to obtain a color filter (see FIG. 19I).

Figure 20:
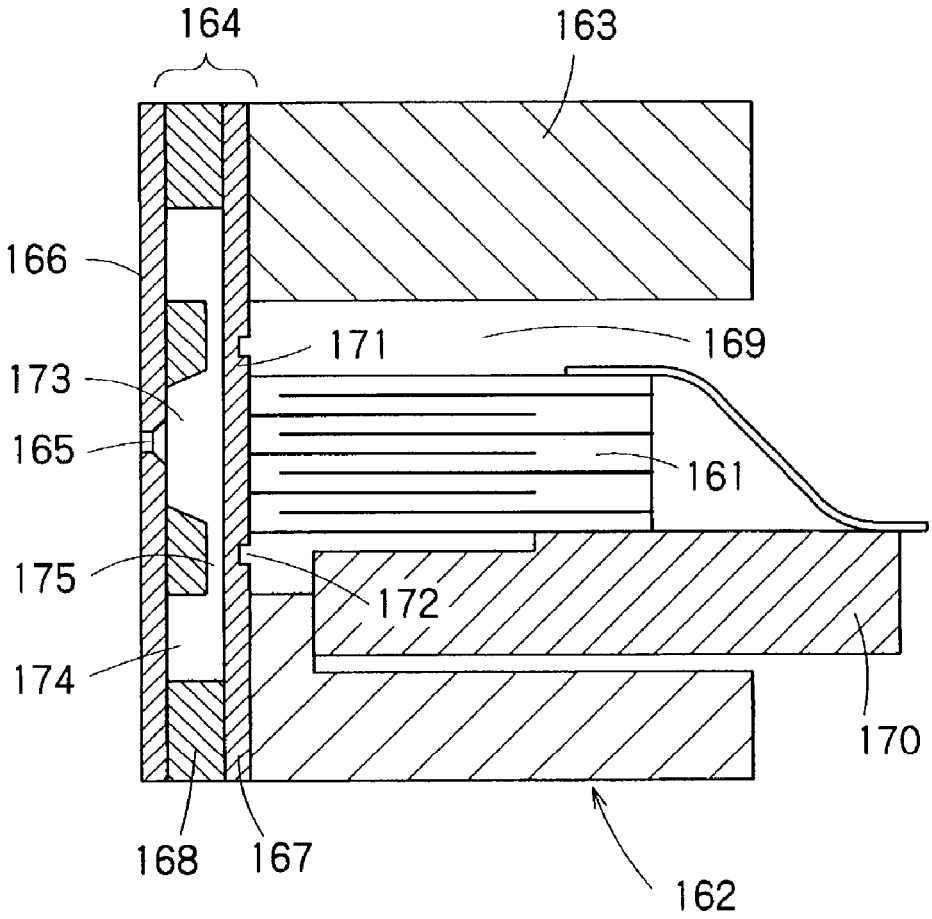
FIG. 20 is a cross-section showing a detailed construction of another example of a head section of the droplet discharge device shown in FIG. 1.

In the above embodiments, the head section 201 using the piezoelectric vibrator 225 of a deflection vibration mode is illustrated, but the present invention is also applicable to a droplet discharge device, shown in FIG. 20, having a head section (droplet discharge head) 162, using a piezoelectric vibrator 161 of a longitudinal vibration mode.

This head section 162 comprises a base 163 made of a synthetic resin, and a flow path unit 164 attached on the front face (corresponding to the left side in the figure) of the base 163. The flow path unit 164 comprises a nozzle plate 166 having a nozzle opening 165 formed therein, a diaphragm 167 and a flow path forming plate 168.

The base 163 is a block member having a storage space 169 opened on the front and rear faces. In this storage space 169, a piezoelectric vibrator 161 secured onto a fixed substrate 170 is stored.

The nozzle plate 166 is a thin plate member having a plurality of nozzle openings 165 formed therein along a direction crossing with the scanning direction. Each nozzle opening 165 is set at a predetermined pitch corresponding to the dot forming density. The diaphragm 167 is a plate member having an island portion 171 as a thick portion where the piezoelectric vibrator 161 contacts, and a resilient thin portion 172 provided so as to surround the island portion 171.

A plurality of island portions 171 is provided at a predetermined pitch, so that one island portion 171 corresponds to one nozzle opening 165.

The flow path forming plate 168 is provided with a pressure chamber 173, a common liquid chamber 174, and an opening for forming a liquid supply path 175 connecting the pressure chamber 173 and the common liquid chamber 174.

The nozzle plate 166 is arranged on the front face of the flow path forming plate 168, and the diaphragm 167 is arranged on the rear side, so as to form the flow path unit 164 with the flow path forming plate 168 being interposed between the nozzle plate 166 and the diaphragm 167 and integrated by bonding or the like.

In this flow path unit 164, a pressure chamber 173 is formed on the rear side of the nozzle opening 165, and the island portion 171 of the diaphragm 167 is located on the rear side of the pressure chamber 173. The pressure chamber 173 and the common liquid chamber 174 communicate with each other by the liquid supply path 175.

The tip of the piezoelectric vibrator 161 abuts against the island portion 171 on the rear side, and in this abutted condition, the piezoelectric vibrator 161 is fixed to the base 163. A drive pulse or printing data (SI) are supplied to the piezoelectric vibrator 161 via a flexible cable.

The piezoelectric vibrator 161 of a longitudinal vibration mode has a characteristic in that it contracts in a direction orthogonal to the electric field, when being charged with electricity, and expands in the direction orthogonal to the electric field, when being discharged. Therefore, in this head section 162, the piezoelectric vibrator 161 contracts rearwards when being charged, and with this contraction, the island portion 171 is brought back rearwards, and the contracted pressure chamber 173 expands. Accompanying this expansion, the liquid in the common liquid chamber 174 flows into the pressure chamber 173 through the liquid supply path 175. On the other hand, when being discharged, the piezoelectric vibrator 161 expands forwards, and the island portion 171 of the resilient plate is pushed forwards, and the pressure chamber 173 contracts. With this contraction, the liquid pressure in the pressure chamber 173 increases.

As described above, in this head section 162, the relation between the voltage level due to charging or discharging the piezoelectric vibrator 161 and the expansion or contraction of the pressure chamber 173, is opposite to the case of the head section 201 shown in FIG. 3. In this head section 162, filling of liquid into the pressure chamber 173 is carried out by increasing the voltage. Similarly, discharge of droplets is carried out by decreasing the voltage.

The present invention is applicable not only to a droplet discharge device comprising a head section using a piezoelectric vibrator of a deflection vibration mode or a longitudinal vibration mode, but also to a droplet discharge device comprising a head section in which droplets are discharged by generating pressure by heating the liquid.

Figure 21:
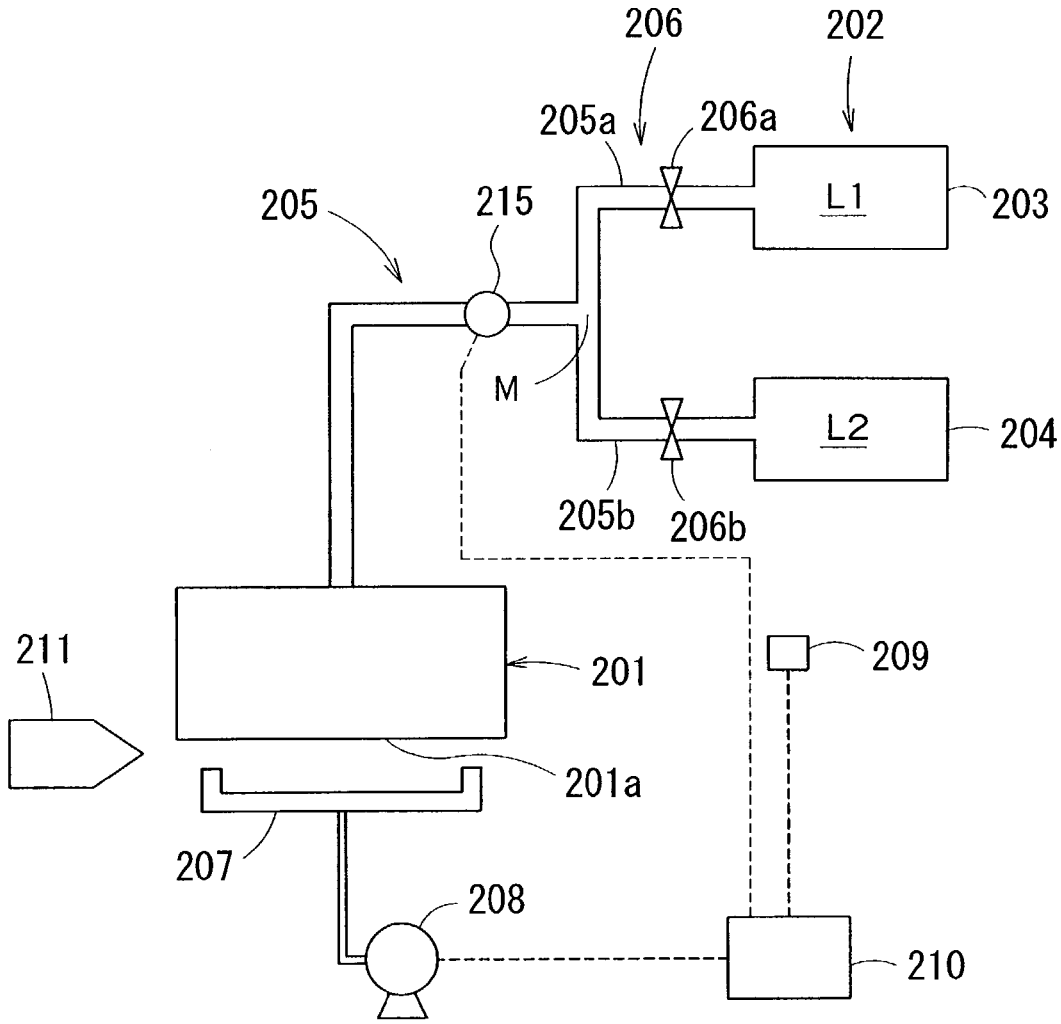
FIG. 21 is a schematic block diagram of a droplet discharge device having a pressure device.

In the above embodiments, the construction is such that the first liquid and the second liquid are filled into the droplet discharge head by negative pressure suction of a suction unit having a suction pump. But the present invention is not limited to this construction, and for example, as shown in FIG. 21, the construction may be such that a pressurizing unit 215 such as a pressurizing pump is provided in a liquid supply tube 205, and the liquid is filled into a head section 201 by pressurizing the liquid supplied to the head section 201. Also in this case, as in the case where the liquid is filled by negative pressure suction, the liquid can be filled into the head section 201 under optimum conditions, by setting the pressurizing conditions (pressurizing force and pressurizing time) corresponding to the viscosity of the liquid to be filled into the head section 201. When the liquid is filled into the head section 201 by pressurizing, the suction pump 208 is not always necessary, but it can be used for reliably recovering the liquid discharged to a cap member 207 from the head section 201.

In the above embodiments, explanation has been given for the case where a drawing (film production) process is carried out by discharging one kind of liquid onto the substrate.

However, the present invention is not limited thereto, and the construction may be such that one head section 201 is used to separately discharge a plurality of liquids of different kinds, to form a film on the substrate. For example, in the case where a resist and metal wiring are to be formed on the substrate, it is possible that a first liquid containing the resist material is filled into the head section 201 by using the above described liquid filling method, and the liquid is discharged onto the substrate to form a film, and then the first liquid is replaced by a second liquid such as acetone also having a function as a cleaning solution, and thereafter a different first liquid containing a metal material replaces the second liquid, and is filled into the head section 201. The metal material is then discharged from the head section 201 onto the substrate, to be formed as wiring. In this case, a plurality of kinds of liquids having high viscosity can be film-formed on the substrate with one apparatus, thereby enabling improvement in the production efficiency. The second liquid used herein desirably has non-reactivity and compatibility with respect to the plurality of first liquids.

The present invention is not limited to the above embodiments, and various changes are possible without departing from the scope of claims.

The device manufacturing apparatus of the present invention is not limited to manufacturing for example color filters for liquid crystal display devices, and for example, is applicable to EL (electroluminescence) display devices. The EL display device is an element having a configuration such that a thin film including fluorescent inorganic and organic compounds is interposed between a cathode and an anode, and electrons and positive holes are injected into the thin film and recombined, to thereby generate excitons, and the discharge of light (fluorescence and phosphorescence) at the time when the excitons are deactivated is used to emit light. Of the fluorescent materials used for the EL display device, materials exhibiting luminescent colors of red, green and blue are patterned by droplet discharge on a device substrate such as a TFT, using the device manufacturing apparatus of the present invention, thereby enabling a spontaneous light-emitting full color EL display device to be manufactured. The scope of the device in the present invention includes a substrate of such an EL display device.

Figure 22:
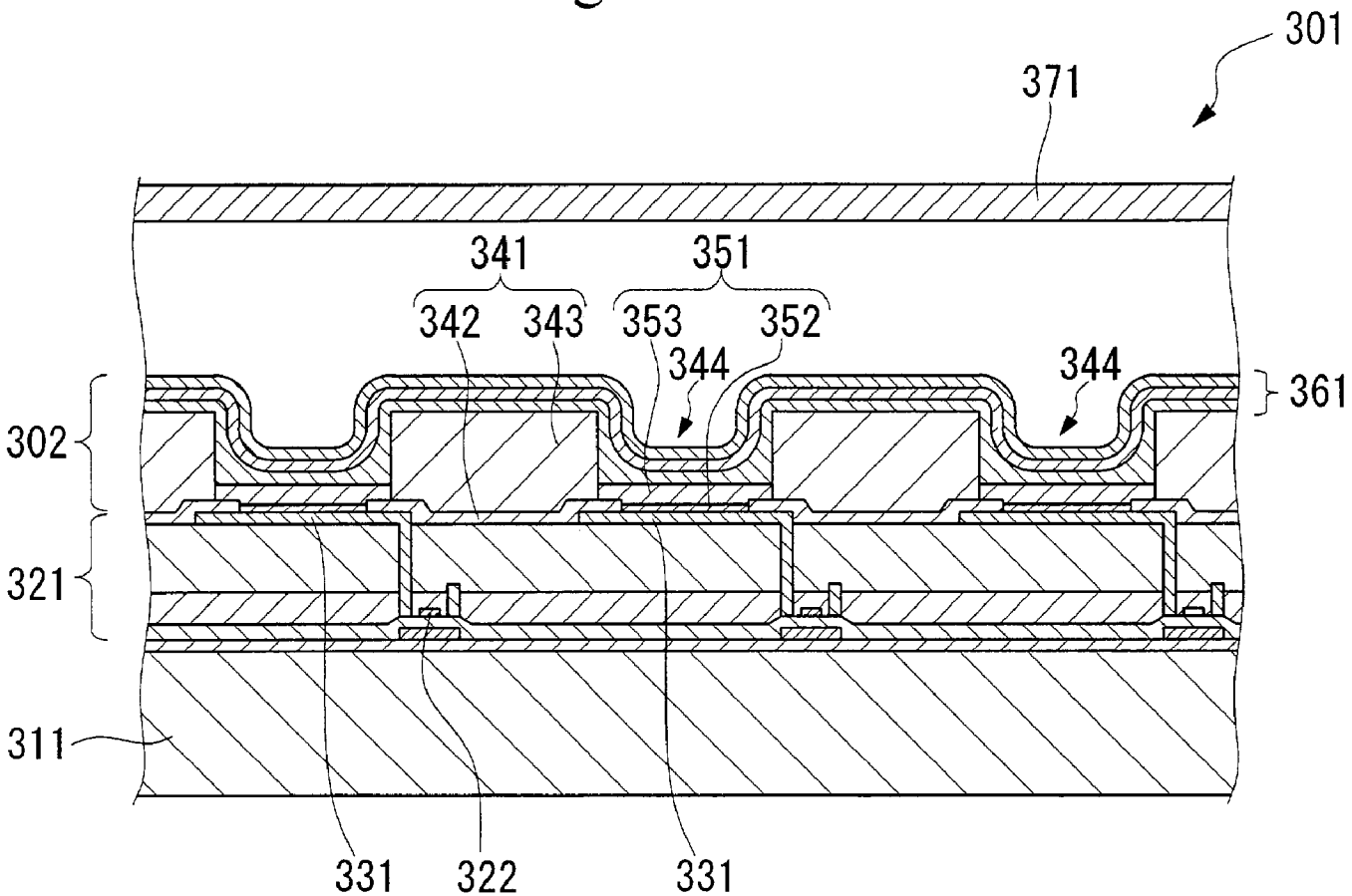
FIG. 22 is a cross-section of an organic EL device to which the manufacturing method of the present invention is applicable.

FIG. 22 is a cross-section of an organic EL device to which the manufacturing method of the present invention is applicable.

As shown in FIG. 22, this organic EL device 301 is obtained by connecting an organic EL element 302 comprising a substrate 311, a circuit element portion 321, pixel electrodes 331, bank portions 341, light emission elements 351, a cathode 361 (counter electrode) and a sealing substrate 371, to wiring and a drive IC (not shown in the figure) of a flexible substrate (not shown in the figure). The circuit element portion 321 is formed on the substrate 311, and a plurality of pixel electrodes 331 connected to a TFT 322, being a switching element, are aligned on the circuit element portion 321. The bank portions 341 are formed in the form of a lattice between the respective pixel electrodes 331. The light emission elements 351 are formed in depressed openings 344 generated by the bank portions 341. The cathode 361 is formed over the whole upper surface of the bank portions 341 and the light emission elements 351, and the sealing substrate 371 is laminated on the cathode 361 comprising LiF (lithium fluoride)/Ca (calcium)/Al (aluminum).

The manufacturing process of the organic EL apparatus 301 including the organic EL element comprises: a bank portion forming step for forming the bank portions 341; a plasma treatment step for appropriately forming the light emission elements 351; a light emission element forming step for forming the light emission elements 351; a counter electrode forming step for forming the cathode 361; and a sealing step for laminating the sealing substrate 371 on the cathode 361 for sealing.

The light emission element forming step is for forming the light emission elements 351 by forming a hole injection and transportation layer 352 and a light-emitting layer 353 on the depressed openings 344, that is, on the pixel electrodes 331, and comprises a hole injection and transportation layer forming step and a light emitting layer forming step. The hole injection and transportation layer forming step has a first droplet discharge step for discharging a first composition (functional liquid) for forming the hole injection and transportation layer 352 onto each pixel electrode 331, and a first drying step for drying the discharged first composition to form the hole injection and transportation layer 352. The light emitting layer forming step has a second droplet discharge step for discharging a second composition (functional liquid) for forming the light-emitting layer 353 onto the hole injection and transportation layer 352, and a second drying step for drying the discharged second composition to form the light-emitting layer 353. In this light emitting layer forming step, the light emission element is formed by using the above described droplet discharge device.

In this case, the device manufacturing apparatus of the present invention may have a step for carrying out surface treatment such as plasma, UV treatment and coupling, with respect to the resin resist, the pixel electrode, and the surface of a layer which becomes the lower layer, so that the EL material easily adheres. The EL display device manufactured using the device manufacturing apparatus of the present invention can be applied to a segment display or a still picture display with simultaneous emission over the whole surface, for example, a low information field such as pictures, characters and labels, or can be used as a light source having a point, line and plane shape. Moreover, by using a passive drive display device as well as an active device such as the TFT for driving, a full color display device having high luminance and excellent response can be obtained. Furthermore, if a metal material and an insulating material are used in the droplet discharge patterning technique of the apparatus, direct fine patterning of metal wiring and insulation films becomes possible. The device manufacturing apparatus of the present invention is also applicable to manufacturing PDPs (plasma display panels) using this metal wiring forming technique, or preparation of novel high-performance devices such as antennas for wireless tags.

Furthermore, the droplet discharge head 14 of the illustrated filter production apparatus is one which can discharge one kind of liquid of R (red), G (green) or B (blue), but needless to say, it is also possible to discharge two or three kinds of these liquids at the same time.

Figure 23A:
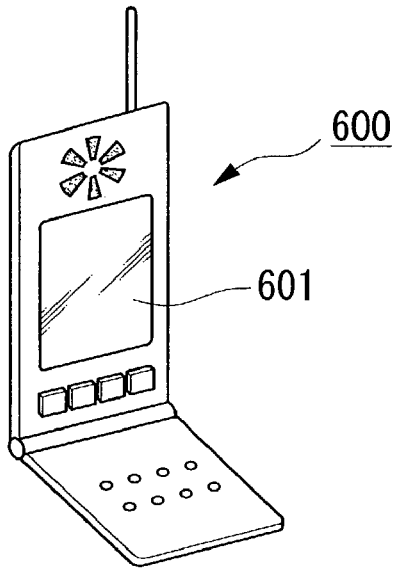
FIGS. 23A to 23C show examples of electronic equipment incorporating a display device, FIG. 23A being a perspective view of a portable telephone, FIG. 23B being a perspective view of a portable information processor, and FIG. 23C being a perspective view of a wrist watch type electronic device.
Figure 23B:
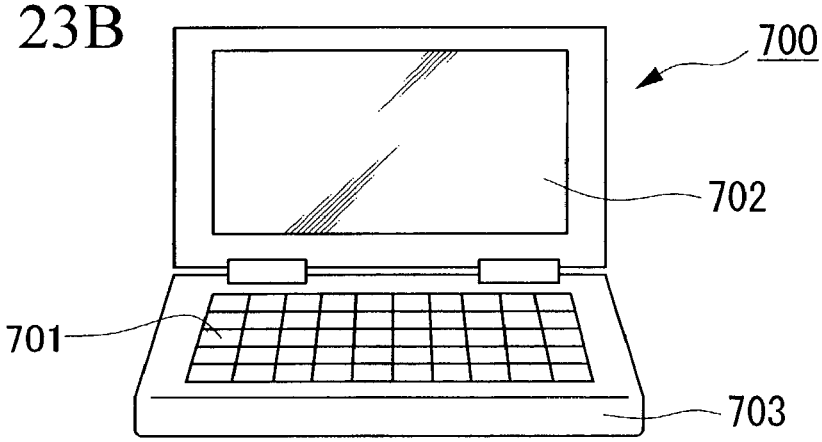
Figure 23C:
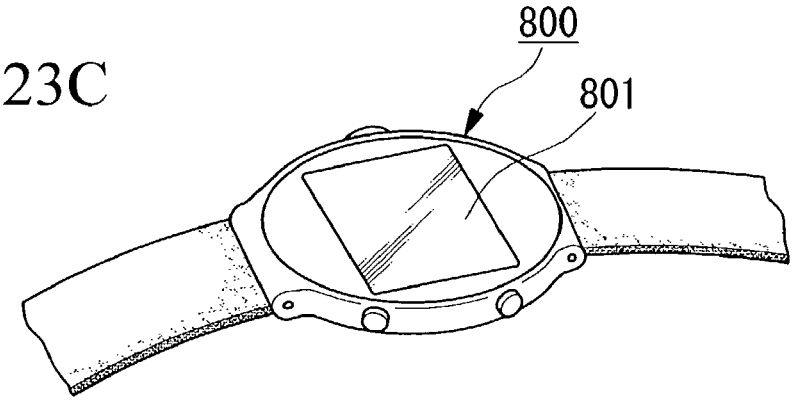

The electronic equipment, in which the device according to the embodiment is assembled, includes various electronic equipment, such as personal computers, portable telephones, electronic pocketbooks, pagers, POS terminals, IC cards, mini disk players, liquid crystal projectors, engineering workstations (EWS), word processors, TVs, video tape recorders of a view finder type or a monitor direct-view type, electronic desk calculators, car navigation apparatus, apparatus having a touch panel, watches and game equipment. For example, FIG. 23A is a perspective view showing an example of a portable telephone. In FIG. 23A, reference symbol 600 denotes a portable telephone body, and reference symbol 601 denotes a display section using the color filter. FIG. 23B is a perspective view showing an example of a portable information processor such as a word processor or personal computer. In FIG. 23B, reference symbol 700 denotes an information processing unit, reference symbol 701 denotes an input section such as a key board, reference symbol 703 denotes an information processing unit body, and reference symbol 702 denotes a display section using the color filter. FIG. 23C is a perspective view showing an example of a wrist watch type electronic device. In FIG. 23C, reference symbol 800 denotes a watch body, and reference symbol 801 denotes a display section using the color filter. Since the electronic equipment shown in FIG. 23A to FIG. 23C comprise the color filter of the above embodiments, electronic equipment having a color filter manufacturable at high quality and high throughput can be realized.

INDUSTRIAL APPLICABILITY

As described above, in the present invention, the first liquid and the second liquid having a lower viscosity than the first liquid can be selectively supplied to the head section. At the time of initial filling of the liquid into the head section, at first the second liquid having low viscosity is filled into the head section, and then the filled second liquid can be replaced by the first liquid. Hence, even if the viscosity of the first liquid is high, the first liquid can be reliably filled without residual bubbles, into the interior of liquid flow passages having a complicated construction formed in the head section.

On completion of predetermined processing using the droplet discharge device, the first liquid inside the head section can be discharged and replaced by the low viscosity second liquid. Therefore, even in the case of reusing the droplet discharge device after an idle period, clogging or the like of liquid inside the head section can be prevented.

What is claimed is:

1. A droplet discharge device which discharges liquid filled into a droplet discharge head, having a filling apparatus which switches between a first liquid and a second liquid of a lower viscosity than said first liquid, and fills said droplet discharge head, wherein viscosity of said first liquid is from 10mPa·s to 50mPa·s.

2. A droplet discharge device according to claim 1, wherein said first liquid and said second liquid are liquids for which phase separation does not occur therebetween.

3. A droplet discharge device according to claim 2, wherein said second liquid is a solvent of said first liquid.

4. A droplet discharge device according to claim 1, wherein said second liquid has a high wettability with respect to the material constituting the liquid flow path of said droplet discharge head.

5. A droplet discharge device according to claim 1, wherein said second liquid also serves as a cleaning solution used in cleaning of said droplet discharge head.

6. A droplet discharge device according to claim 1, wherein said second liquid is a heated first liquid.

7. A droplet discharge device according to claim 1, wherein the viscosity of said second liquid is less than 4mPa·s.

8. A droplet discharge device according to claim 1, comprising a pressure device which pressurizes the liquid supplied to said droplet discharge head to fill said droplet discharge head.

9. A droplet discharge device according to claim 8, wherein a pressurizing condition for said liquid is set based on the viscosity of the liquid to be supplied to said droplet discharge head.

10. A droplet discharge device according to claim 1, comprising a suction device which fills the liquid supplied to said droplet discharge head into said droplet discharge head by means of a negative pressure suction.

11. A droplet discharge device according to claim 10, wherein said suction device comprises a cap member which is pressed onto a nozzle forming face of said droplet discharge head to form a closed space with said nozzle forming face, and a suction pump which creates a negative pressure in said closed space.

12. A droplet discharge device according to claim 11, wherein at least a part of said cap member in contact with the liquid is liquid resistant.

13. A droplet discharge device according to claim 11, further having a temperature sensor which measures the ambient temperature of said droplet discharge device, and a suction amount of said suction pump is controlled in accordance with said ambient temperature measured by said temperature sensor.

14. A droplet discharge device according to claim 10, wherein suction conditions for said liquid are set based on the viscosity of the liquid to be supplied to said droplet discharge head.

15. A droplet discharge device according to claim 1, further comprising a laser device which detects droplets discharged from a nozzle opening formed in said droplet discharge head.

16. A droplet discharge device according to claim 1, having a de-gassifier which de-gasses the liquid supplied to said droplet discharge head before filling into said droplet discharge head.

17. A droplet discharge device according to claim 1, having a control device which controls said filling apparatus so that after the discharge process of said first liquid, said first liquid which has been filled into said droplet discharge head is again replaced by said second liquid.

18. A device manufacturing apparatus having a droplet discharge device which impacts liquid discharged from a droplet discharge head onto a substrate to perform a film production process on said substrate, wherein the droplet discharge device according to claim 1 is used as said droplet discharge device.

19. A device manufacturing apparatus according to claim 18, wherein a plurality of liquids of different types are respectively used as said first liquid, and each liquid is discharged to respectively produce a film on said substrate.

20. A droplet discharge device according to claim 1, wherein said filling apparatus comprises:

a liquid storage section for storing liquid for supply to said droplet discharge head, having a first storage section for storing said first liquid and a second storage section for storing said second liquid, a liquid supply path section which connects said droplet discharge head and said liquid storage section to form a liquid supply path to said droplet discharge head, with a tip side communicated with said droplet discharge head and a base side branched into a first branch path communicated with said first storage section, and a second branch path communicated with said second storage section, and a switching device which switches between supply of said first liquid from said first storage section and supply of said second liquid from said second storage section.

21. A droplet discharge device according to claim 20, wherein said first liquid and said second liquid are liquids of mutually different colors, and said liquid supply path section is formed with a transparent material at at least a portion of a branch point where said first branch path and said second branch path are joined.

22. A droplet discharge device according to claim 21, further having an optical sensor which detects liquid inside said liquid supply path section via the transparent portion of said branch point of said liquid supply path section.

23. A droplet discharge device according to claim 20, wherein said switching device has a first valve provided in said first branch path and a second valve provided in said second branch path.

24. A droplet discharge device according to claim 20, wherein said first branch path is shorter than said second branch path.

25. A droplet discharge device according to claim 20, wherein said first branch path is thicker than said second branch path.

26. A droplet discharge device according to claim 20, wherein said liquid storage section has a third storage section for storing a third liquid of a lower viscosity than said first liquid and a higher viscosity than said second liquid, and said liquid supply path section has a third branch path with a tip side communicating with said droplet discharge head, and a base side communicating with said third storage section, and said switching device switches between supply of said first liquid from said first storage section, supply of said second liquid from said second storage section, and supply of said third liquid from said third storage section.

27. A droplet discharge device according to claim 26, wherein said switching device has a first valve provided in said first branch path, a second valve provided in said second branch path, and a third valve provided in said third branch path.

28. A droplet discharge device according to claim 26, wherein said second liquid is a solvent of said third liquid, and said third liquid is a solvent of said first liquid.

29. A liquid filling method for a droplet discharge device which fills a first liquid into a droplet discharge head of a droplet discharge device which discharges a liquid filled into said droplet discharge head, comprising the steps of:

filling a second liquid of a lower viscosity than said first liquid into said droplet discharge head; and replacing said second liquid which has been filled into said droplet discharge head with said first liquid, wherein said droplet discharge device comprises:

a liquid storage section for storing liquid for supply to said droplet discharge head, having a first storage section for storing said first liquid and a second storage section for storing said second liquid, and a liquid supply path section which connects said droplet discharge head and said liquid storage section to form a liquid supply path to said droplet discharge head, with a tip side communicated with said droplet discharge head and a base side branched into a first branch path communicated with said first storage section, and a second branch path communicated with said second storage section, and in a condition where liquid is not filled to inside of said droplet discharge head, said first liquid is supplied from said first storage section and said first liquid is filled to inside said liquid supply path portion up until a branch point where said first branch path and said second branch path are joined, and supply of said first liquid from said first storage section is stopped, and said second liquid is supplied from said second storage section to fill said second liquid to inside said liquid discharge head, and supply of said second liquid from said second storage section is stopped, and said first liquid is supplied from said first storage section, and while discharging said second liquid filled to inside said droplet discharge head and said liquid supply path, from a nozzle opening formed in said droplet discharge head, said first liquid is introduced to said droplet discharge head, and said second liquid inside said droplet discharge head is replaced by said first liquid, and said first liquid is filled to inside said droplet discharge head.

30. A liquid filling method for a droplet discharge device according to claim 29, including a step for again replacing said first liquid which has been filled into said droplet discharge head and filling with said second liquid after a discharge process for said first liquid.

31. A liquid filling method for a droplet discharge device according to claim 30, wherein said liquid storage section has a third storage section for storing a third liquid of a lower viscosity than said first liquid and a higher viscosity than said second liquid, and said liquid supply path section has a third branch path with a tip side communicating with said droplet discharge head, and a base side communicating with said third storage section, and in a condition where liquid is not filled to inside said droplet discharge head, said first liquid is supplied from said first storage section, and if said first liquid reaches to the branch point where said first branch path, said second branch path and said third branch path are joined, supply of said first liquid from said first storage section is stopped, while on the other hand, if said third liquid is supplied from said third storage section and said third liquid reaches to said branch point, supply of said third liquid from said third storage section is stopped, and said second liquid is supplied from said second storage section via said liquid supply path section to said droplet discharge head, and said second liquid fills to inside of said droplet discharge head, and supply of said second liquid from said second storage section is stopped and said third liquid is supplied from said third storage section, and while discharging said second liquid filled to inside said droplet discharge head and said liquid supply path section, from said nozzle opening of said droplet discharge head, said third liquid is introduced to said droplet discharge head, and said second liquid inside said droplet discharge head is replaced by said third liquid, and said third liquid is filled to inside said droplet discharge head, and supply of said third liquid from said third storage section is stopped and said first liquid is supplied from said first storage section, and while discharging said third liquid filled to inside said droplet discharge head and said liquid supply path section, from said nozzle opening of said droplet discharge head, said first liquid is introduced to said droplet discharge head, and said third liquid inside said droplet discharge head is replaced by said first liquid, and said first liquid is filled to inside said droplet discharge head.

32. A liquid filling method for a droplet discharge device according to claim 30, wherein said droplet discharge device comprises:

a liquid storage section for storing a liquid for supply to said droplet discharge head, having a first storage section for storing said first liquid, and a second storage section for storing said second liquid, and a liquid supply path section which connects said droplet discharge head and said liquid storage section to form a liquid supply path to said droplet discharge head, with a tip side communicated with said droplet discharge head and a base side branched into a first branch path communicated with said first storage section, and a second branch path communicated with said second storage section, and after performing a predetermined operation of discharging said first liquid from said droplet discharge head, supply of said first liquid from said first storage section to said droplet discharge head is stopped, and said second liquid is supplied from said second storage section, and while discharging said first liquid filled to inside said droplet discharge head and said liquid supply path portion, from a nozzle opening formed in said droplet discharge head, said second liquid is introduced to said droplet discharge head, and said first liquid inside said droplet discharge head is replaced by said second liquid, and said second liquid is filled to inside said droplet discharge head.

33. A liquid filling method for a droplet discharge device according to claim 29, wherein said first liquid and said second liquid are liquids of mutually different colors, and said liquid supply path section is formed with a transparent material at at least a portion of the branch point where said first branch path and said second branch path are joined, and there is further provided an optical sensor which detects liquid inside said liquid supply path section via the transparent portion of said branch point of said liquid supply path section, and when said first liquid is filled to inside said liquid supply path section up to said branch point, if detected by said sensor that said liquid has reached to said branch point, supply of said first liquid from said first storage section is stopped.

34. A liquid filling method for a droplet discharge device according to claim 29, wherein supply of liquid from said liquid storage section is performed by pressurizing said liquid.

35. A liquid filling method for a droplet discharge device according to claim 34, wherein pressurizing conditions for said liquid are set based on the viscosity of the liquid to be supplied to said droplet discharge head.

36. A liquid filling method for a droplet discharge device according to claim 29, wherein supply of the liquid from said liquid storage section is performed by making a closed space formed by pressing a cap member against a nozzle forming face of said droplet discharge head, a negative pressure.

37. A liquid filling method for a droplet discharge device according to claim 36, wherein a negative pressure suction condition for said liquid is set based on the viscosity of the liquid to be supplied to said droplet discharge head.

38. A liquid filling method for a droplet discharge device according to claim 29, having a step for de-gassing the liquid supplied to said droplet discharge head before filling into said droplet discharge head.

39. A liquid filling method for a droplet discharge device according to claim 29, wherein said first liquid and said second liquid are liquids for which phase separation does not occur therebetween.

40. A liquid filling method for a droplet discharge device according to claim 39, wherein said second liquid is a solvent of said first liquid.

41. A liquid filling method for a droplet discharge device according to claim 29, wherein said second liquid is a heated first liquid.

42. A liquid filling method for a droplet discharge device according to claim 29, wherein the viscosity of said first liquid is from 10mPa·s to 50mPa·s.

43. A liquid filling method for a droplet discharge device according to claim 29, wherein the viscosity of said second liquid is less than 4mPa·s.

44. A device manufacturing method for manufacturing a device using a droplet discharge device having a droplet discharge head which discharges a liquid, comprising a step for filling said liquid into said droplet discharge head using the liquid filling method according to claim 29.

45. A device manufacturing method according to claim 44, wherein a plurality of liquids of different types are respectively used as said first liquid, and each liquid is discharged to respectively produce a film on said substrate.

* * * * *